US009855175B2

(12) United States Patent
Wike, Jr. et al.

(10) Patent No.: US 9,855,175 B2
(45) **Date of Patent: *Jan. 2, 2018**

(54) DYNAMIC SEATING AND WALKING WHEELCHAIR WITH AN ACTIVE SEAT WITH POWERLIFT TO STAND

(71) Applicant: Active Body, Inc., Sugar Hill, GA (US)

(72) Inventors: Charles Kenneth Wike, Jr., Sugar Hill, GA (US); Michael Alan Kapp, Gig Harbor, WA (US); Richard Michael McEntyre, Greenville, SC (US)

(73) Assignee: Active Body, Inc., Sugar Hill, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/583,804

(22) Filed: May 1, 2017

(65) Prior Publication Data

US 2017/0258653 A1 Sep. 14, 2017

Related U.S. Application Data

(63) Continuation of application No. 15/064,972, filed on Mar. 9, 2016, now Pat. No. 9,649,236.

(51) Int. Cl.
*A61G 5/14* (2006.01)
*A61G 5/10* (2006.01)
(Continued)

(52) U.S. Cl.
CPC ..... *A61G 5/14* (2013.01); *A61G 5/1005* (2013.01); *A61G 5/1067* (2013.01); *A61G 5/125* (2016.11);
(Continued)

(58) Field of Classification Search
CPC ..... A61G 5/14; A61G 5/1056; A61G 5/1067; A61G 5/107; A61G 5/12; A61G 2200/34;
(Continued)

(56) References Cited

U.S. PATENT DOCUMENTS 4,211,426 A * 7/1980 Motloch ..... A47D 13/04 280/87.041
4,456,086 A * 6/1984 Wier ..... A61G 5/14 180/11
(Continued)

OTHER PUBLICATIONS

International Search Report and Written Opinion for International Application No. PCT/US17/15619, dated Mar. 3, 2017 (ISA).

*Primary Examiner* — John D Walters
(74) *Attorney, Agent, or Firm* — Jeffery C. Watson; Mathew L. Grell; Grell & Watson Patent Attorneys LLC

(57) ABSTRACT

A dynamic seating and walking wheelchair includes an active seat and a frame. The active seat is configured to move from a seated position to a standing position. The active seat includes a seat back with an upper end and a lower end, and a seat bottom with a front end and a rear end. The rear end of the seat bottom is rotatable about a movable pivot axis approximate to the lower end of the seat back from the seated position of approximately horizontal to the standing position of approximately vertical. The frame is configured to support the active seat. Wherein, when the active seat moves from a seated position to a standing position, the movable pivot axis moves both up and backwards.

19 Claims, 23 Drawing Sheets

(51) Int. Cl.
*A61G 5/12* (2006.01)
*A61G 7/10* (2006.01)

(52) U.S. Cl.
CPC ..... *A61G 5/128* (2016.11); *A61G 7/1046* (2013.01); *A61G 7/1051* (2013.01)

(58) Field of Classification Search
CPC .... A61G 2200/36; A61G 5/125; A61G 5/128; A61G 5/1005; A61G 7/1046; A61G 7/1051
USPC ..... 280/642, 647, 648, 650, 657
See application file for complete search history.

(56) References Cited

U.S. PATENT DOCUMENTS

| | | | | | |
|---|---|---|---|---|---|
| 6,125,957 | A * | 10/2000 | Kauffmann | A61G 5/14 | 180/65.1 |
| 6,224,154 | B1 * | 5/2001 | Stoki | A61B 90/60 | 297/338 |
| 6,619,681 | B2 * | 9/2003 | Gutierrez | A61G 5/14 | 280/250.1 |
| 6,976,698 | B2 * | 12/2005 | Kuiken | A61G 5/14 | 280/250.1 |
| 7,273,255 | B2 * | 9/2007 | Nylander | A61G 5/1059 | 297/330 |
| 7,614,639 | B2 * | 11/2009 | Tholkes | A47C 9/002 | 280/47.4 |
| 7,716,759 | B2 * | 5/2010 | Wilder | A61G 7/1011 | 280/47.41 |
| 8,151,812 | B2 * | 4/2012 | Razon | A61H 3/04 | 135/66 |
| 2015/0257950 | A1 * | 9/2015 | Ten Holter | A61G 5/14 | 297/316 |

* cited by examiner

DYNAMIC SEATING AND WALKING WHEELCHAIR WITH AN ACTIVE SEAT WITH POWERLIFT TO STAND

CROSS-REFERENCE TO RELATED APPLICATIONS

This application is a continuation of and claims priority benefit to U.S. non-provisional patent application Ser. No. 15/064,972, filed Mar. 9, 2016, entitled "A Dynamic Seating and Walking Wheelchair with an Active Seat with Powerlift to Stand," which is incorporated by reference herein.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The present disclosure relates to wheelchairs and walkers, and more particularly to a dynamic seating and walking wheelchair with an active seat with powerlift to stand which, in addition to functioning as a standard wheelchair, further assists the user to come to a standing position, and stabilizes the user while standing and walking.

Description of the Related Art

Within the United States approximately five percent of the population over the age of sixty-five uses some sort of assistive device for their primary mode of transportation (manual propelled wheelchairs, electric power wheelchairs, motorized scooters, walkers/rollators, etc.).

With the growth in the aging population the demand for assisted walking devices is expected to grow and as the population ages and the average life expectancy increases the need for devices that assist walking as compared to replace walking will grow in demand. The need will be facilitated not only by a degradation of the ability to walk (e.g., due to muscular skeletal degeneration) but by surgical intervention associated with age (e.g., hip and knee replacement).

Traditional walking assist devices do not adequately address a transitional phase where an individual can walk some of the time but needs the ability to transition into a sitting position. Neither do they address the ability of a user to stand intermediately or the need for assisted devices during rehabilitation. Persons sitting for long periods of time may suffer from a wide range of physical issues (discomforts, poor postural, lack of stability, difficulties with breathing, incontinence, pressure ulcers and other skin disorders). However, research indicates that people confined to a wheelchair may also be susceptible to physiological complications associated when unable to perform certain tasks unassisted and the inability to be in a standing position when interacting with other individuals.

Various devices have been investigated to assist in transitioning a person to a standing position. For example, devices that raise the person within a seated position to the height of a standing person and walkers that attached to a wheelchair allowing the person to pull themselves into a standing position are marketed. These devices do not facilitate walking where possible, and often place the individual's body in an unnatural position which can lead to not using the devices and further physical complications. For example, an important function during rehabilitation requires that the person be able to hold their body weight and provide sufficient stress on the muscular skeletal system to facilitate healing of fractured bones and joint revision surgery.

The physical and psychological benefits of wheelchairs which bring the user to a standing position have long been recognized. A person who remains seated all of the time may suffer a broad range of complications and discomforts, including skin breakdown, problems with postural stability, difficulties with breathing and swallowing, incontinence, impaired sensation, and pressure ulcers. These different conditions of use create a need for a device able to provide support during walking, and provide the user with the functionality of a traditional wheelchair and the ability to easily transition between the assisted walking and/or standing versus seated position.

A variety of different devices have been proposed for relieving these problems by raising a wheelchair user from a seated position to a standing position, or assisting a wheelchair user to maintain a standing position or ambulate with his or her legs. In this regard, two general types of devices are known. The first types of device are wheelchairs which raise the user to a standing position. The second types of device are walkers which attach to a wheelchair or used in conjunction with a wheelchair.

The first type of device raises the wheelchair user to a standing position, but retains the user's feet secured to the footrests or other parts of the wheelchair. Examples of this type of device are found in the following U.S. Pat. Nos.: 4,054,319; 4,067,249; 4,598,944; 5,096,008; 5,366,036; and 5,772,226. While in the standing position in this type of device, the device is generally not propelled by the user's feet, but instead by other means such as a second person, by the user's arms, or by a self-contained motor. While many of these devices combine the features of a general purpose wheelchair with a "stand-up" mechanism, the geometry of these devices places the users' body in a position which is not naturally balanced for standing or appropriate for use as a walker.

The second type of device functions as a walker, allowing a wheelchair user not only to stand, but also to ambulate using his or her own feet to propel the device. Examples of this type of device are found in the following U.S. Pat. Nos.: 2,596,055; 3,023,048; 3,398,974; 3,999,778; and 4,948,156. There are known physical benefits in assisting a person to a standing position where the person's own skeletal structure provides the support. Such benefits include improved bowel and bladder regularity, strengthening of the cardiovascular system, reduction of edema in lower extremities, assisting the lungs in staying clear, improved digestive metabolic process, lessening of muscle spasms and contractions, stretching of tendons and ligaments in lower extremities, and reducing calcium loss in bones.

The known walker type of devices generally discloses an attachment to be used in conjunction with a standard wheelchair. For example, U.S. Pat. No. 3,3998,974 describes a walker attachment which enables the patient to stand up and walk in front of the wheelchair. However, few of the walker devices include a self-contained mechanism for assisting the user in coming to a standing position. One of the few devices which does include such a mechanism is found in U.S. Pat. No. 4,948,156, in which the disclosed transportable frame which can be attached to a wheelchair includes a hand-operated winch mechanism. The user operates the winch to activate a seat harness which pulls the user into a standing position. Another disadvantage of this type of device is that the known walker attachments are generally bulky, not easily stored, increase the total weight of the wheelchair, and constitute yet even further equipment with which a handicapped person is surrounded by and isolated within.

The instant disclosure recognizes the need for a dynamic wheelchair which functions both as a wheelchair and as a stander and walker, which is space-efficient, and which brings the user to a standing position with little effort. The instant disclosure also recognizes the further need for a dynamic wheelchair which enables its user to make postural adjustments, i.e., dynamic seating, to allow the user relief from the discomfort and chronic pain associated with sitting in a single static position.

One solution to such problems was described in U.S. Pat. No. 6,619,681 to a dynamic seating and walking wheelchair. This wheelchair is designed to function as a conventional wheelchair that converts into a walker by raising the user to a standing position from a seated position. The seat carriage is slideably attached to vertical support members such that the seat carriage may be slid and positioned from a lower position to an upper position and from the upper position to the lower position. As the seat carriage is raised straight up, the seat swings from a generally horizontal first position to a generally vertical second position. As the seat carriage is lowered straight down, the seat swings from the second position to the first position.

One problem that has been discovered with the device disclosed in U.S. Pat. No. 6,619,681 is that the seat raises straight up vertically and lowers straight down vertically (best shown in FIGS. 6 and 7). This straight up and down movement does not provide for a natural standing progression and/or sitting progression. In addition, this straight up and down movement does not provide any additional gait area for utilizing the device as a walker. Another problem is that the seat swings down forcing the user to basically stand on their own, i.e. with minimal or no assistance from the seat. Similarly, the same difficulty has been discovered when users have to sit, as the seat does not provide enough support as it swings up forcing the user to basically sit down on their own, i.e. with minimal or no assistance from the seat.

Therefore, it is readily apparent that there is a recognizable unmet need for an improved dynamic seating and walking wheelchair that not only functions as a standard wheelchair, but further assists the user to come to a standing position in a natural progression, and stabilizes the user while standing and walking in a created gait area. The instant disclosure is designed to address at least some of the above mentioned problems by providing a dynamic seating and walking wheelchair with an active seat with powerlift to stand. As such, the instant disclosure may be directed to an improved dynamic seating and walking wheelchair, or a dynamic wheelchair with an active seat with powerlift to stand that provides assistance to the user as they stand and/or sit and that creates a gait area for walking.

SUMMARY

Briefly described, in a preferred embodiment, the present apparatus and method overcomes the above-mentioned disadvantages and meets the recognized need for such a device by providing a dynamic seating and walking wheelchair with an active seat with powerlift to stand that not only functions as a standard wheelchair, but further assists the user to stand and/or sit, and stabilizes the user while standing and walking in an extended gait area.

The present apparatus and method may generally include a dynamic seating and walking wheelchair including a frame and an active seat. The frame may be configured to support the active seat. The active seat may be configured to move from a seated position to a standing position. The active seat may include a seat back and a seat bottom. The seat back may have an upper end and a lower end. The seat back may be configured to slide up and down on the frame. The seat bottom may have a front end and a rear end. The rear end of the seat bottom may be rotatable about a movable pivot axis approximate to the lower end of the seat back from the seated position of approximately horizontal to the standing position of approximately vertical. Wherein, when the seat moves from a seated position to a standing position, a movement of the movable pivot axis may be both up and backwards.

One feature of the wheelchair may be that, when the active seat moves from a seated position to a standing position and the movable pivot axis moves both up and backwards, an extended walking gait area may be formed by the backwards movement of the movable pivot axis.

In select embodiments of the dynamic seating and walking wheelchair, when the seat moves from a seated position to a standing position, the movement of the moveable pivot axis that is both upwards and backwards may be in a curved motion or a linear motion.

In other select embodiments of the dynamic seating and walking wheelchair, the frame may include a left rail, a right rail, and a bracket. The bracket may interconnect the left rail and the right rail via a left slide on its left end moveable about the left rail, and a right slide on its right end moveable about the right rail. The bracket may support the rear end of the seat bottom and may allow the seat bottom to rotate about the movable pivot axis from the seated position of approximately horizontal to the standing position of approximately vertical as the bracket moves up and backwards along the left and right rails. In other select embodiments, sliding pins in a guided slot may also serve to cause the seat to track in a desired motion.

In other select embodiments, the frame may further include at least one armrest, including, but not limited to a left armrest and a right armrest. The left armrest may extend from a left side of the seat back and may interconnect the left side of the seat back with the left side of the bracket. The right armrest may extend from the right side of the seat back and may interconnect the right side of the seat back with the right side of the bracket. The left and right armrests may include left and right under supports. Whereby, when the bracket moves the seat bottom from the seated position to the standing position in an upward and backward motion, the seat back may move in a corresponding upward and backward motion. I One feature of the armrests may be the inclusion of rotating grips at their distal ends. The rotating grips may be rotatable from a downward position for the seated position, to an upward position for the standing position.

Another feature of the armrests may be that at least one of the armrests may rotate from its straight position allowing for easier exit and entry by a user.

One feature of the left and right rails of the frame may be the inclusion of stops. The stops may be positioned at a location on the rails corresponding to the seated position for stopping the corresponding left and right slides on the rails from going below the seated position.

In select embodiments of the dynamic seating and walking wheelchair, the frame may further include at least one seat back support, and a seat back track fixed to the seat back for each seat back support. The seat back supports may be configured to support the seat back via moving within the corresponding seat back track when moving upwards and backwards from the seated position to the standing position. In select embodiments, each of the seat back supports may be pivotally fixed to the frame for allowing the backwards motion and/or for allowing of adjustment of the seat back. As such, each of the seat back supports may be configured for adjustment in the seated position by adjusting the angle of the seat back with the seat bottom. In select embodiments, the frame may include two seat back supports (left and right) and two seat back tracks (left and right). The left seat back support may be pivotally connected to the left side of the frame and may be configured to support the seat back via moving within the left seat back track when moving upwards and backwards from the seated position to the standing position. The right seat back support may be pivotally connected to the right side of the frame and may be configured to support the seat back via moving within the right seat back track when moving upwards and backwards from the seated position to the standing position.

In select embodiments, when the seat moves from a seated position to a standing position, where the pivot axis moves both up and back in a curved motion, the left and right rails may be curved rails.

In other select embodiments, when the seat moves from a seated position to a standing position, where the pivot axis moves both up and back in a linear motion, the left and right tracks may be angled tracks.

One feature of the dynamic seating and walking wheelchair may be that when the seat moves from a seated position to a standing position, the seat provides a change of seating heights and support angles from the seated position to the standing position. In select embodiments, the device may have a means to control incremental adjustments which yield different seat heights without the necessity of providing full standing positioning.

Another feature of the dynamic seating and walking wheelchair may be that when the seat moves from a seated position to a standing position, the front end of the seat bottom may raise for an initial portion of the movement from the seated position to the standing position. In select embodiments, the front end of the seat bottom may raise at a slower rate than the rear end of the seat bottom, thereby providing angled support for a user in coming to a stand.

In select embodiments of the dynamic seating and walking wheelchair, the frame may further include at least one seat bottom lever. The seat bottom lever may be rotatably connected to the frame at one end and rotatably connected to the front end of the seat bottom at its other end. Wherein, when the active seat moves from the seated position to the standing position, the seat bottom lever raises the front end of the seat for the initial portion of the movement. In select embodiments, the frame may include two seat bottom levers, a left seat bottom lever and a right seat bottom lever. The left seat bottom lever may be rotatably connected to the left side of the frame at one end and rotatably connected to the left side of the front end of the seat bottom at its other end. The right seat bottom lever may be rotatably connected to the right side of the frame at one end and rotatably connected to the right side of the front end of the seat bottom at its other end.

In select embodiments of the dynamic seating and walking wheelchair, the frame may further include wheels for movement of the wheelchair. The frame may include any number of wheels and configuration of wheels, including four wheels: two rear wheels; and two front wheels. In select embodiments, the two rear wheels may be larger than the two front wheels. In other select embodiments, the front wheels may be positioned at the end of each rail and/or may be rotatable.

Another feature of the dynamic seating and walking wheelchair may be the inclusion of rotatable feet supports. The rotatable feet supports may be configured to rotate out of the gait area for walking. In select embodiments, the feet supports may be positioned at the end of each rail.

In select embodiments, the seating and walking wheelchair may include a power source. The power source may be for raising the active seat from the seated position to the standing position. In select embodiments, the wheelchair may further include lifting controls for raising and lowering the active seat to and from the seated position and standing position. In select embodiments, the frame may further include a housing for the power source, and a lifting device for transferring the energy from the power source to the active seat for raising and lowering the active seat to and from the seated position and standing position. In other select embodiments, the power source may also power the movement of the wheelchair via its wheels (like via the rear wheels). In these powered embodiments, the wheelchair may further include movement controls for maneuvering the wheelchair.

Another feature of the dynamic seating and walking wheelchair may be the inclusion of a braking mechanism. In select embodiments, the braking mechanism may automatically engage upon movement of the active seat to and from the seated and standing positions.

In another configuration or embodiment, the dynamic seating and walking wheelchair may generally include a frame configured to support an active seat. The active seat may be configured to move from a seated position to a standing position. The active seat may include a seat back and a seat bottom. The seat back may have an upper end and a lower end configured to slide up and down on the frame. The seat bottom may have a front end and a rear end. The rear end of the seat bottom may be rotatable about a movable pivot axis approximate to the lower end of the seat back from the seated position of approximately horizontal to the standing position of approximately vertical. Wherein, the front end of the seat bottom may raise for an initial portion of the movement from the seated position to the standing position. In select embodiments of this dynamic seating and walking wheelchair, the front end of the seat bottom may raise at a slower rate than the rear end of the seat bottom, thereby providing support for a user in coming to a stand. When the seat moves from a seated position to a standing position, the seat may provide a change of seating heights and support angles from the seated position to the standing position. Wherein the dynamic seating and walking wheelchair may have an incremental adjustments control which yield different seat heights without the necessity of providing full standing positioning.

In select embodiments, the frame may further include at least one seat bottom lever. The at least one seat bottom lever may be rotatably connected to the frame at one end and rotatably connected to the front end of the seat bottom at its other end. Wherein, when the active seat moves from the seated position to the standing position, the bottom lever may raise the front end of the seat for the initial portion of the movement. In select embodiments, the frame may include two seat bottom levers: a left seat bottom lever and a right seat bottom lever. The left seat bottom lever may be rotatably connected to the frame at one end and rotatably connected to the front end of the seat bottom at its other end. The right seat bottom lever may be rotatably connected to the frame at one end and rotatably connected to the front end of the seat bottom at its other end. In select embodiments, the seat bottom lever or levers may have an angle of greater than ninety degrees when in the seated position, whereby the front end of the seat bottom raises for the initial portion of the movement until the angle reaches ninety degrees.

In use, a method of lifting an active seat of a wheelchair from a seated position to a standing position may be providing utilizing any of the various embodiments of the dynamic seating and walking wheelchair, as shown and/or described herein. This method may generally include the steps of: providing a frame configured to support the active seat; moving a seat back of the active seat with an upper end and a lower end up and down on said frame; and rotating a seat bottom with a front end and a rear end, where the rear end of the seat bottom is rotatable about a movable pivot axis approximate to the lower end of the seat back from the seated position of approximately horizontal to the standing position of approximately vertical; and (a) moving the movable pivot axis at the rear end of the seat bottom both upwards and backwards and/or moving the front end of the seat bottom up for an initial portion of the movement from the seated position to the standing position.

In select embodiments, the dynamic seating and walking wheelchair may include a safety harness system. The safety harness system may be connected to connection points on the wheelchair. The safety harness system may be configured to provide support to the user while standing or walking. In select embodiments, the safety harness system may include upper body safety straps, lower body safety straps, or combinations thereof. The upper body safety straps may be configured to support an upper body of the user while standing or walking. The upper body straps may be connected to the wheelchair by at least one upper connection point. The lower body safety straps may be configured to support a lower body of the user while standing or walking. The lower body safety straps may be connected to the wheelchair by at least one lower connection point.

These and other features of the dynamic seating and walking wheelchair with an active seat with powerlift to stand will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present dynamic seating and walking wheelchair with an active seat with powerlift to stand will be better understood by reading the Detailed Description with reference to the accompanying drawings, which are not necessarily drawn to scale, and in which like reference numerals denote similar structure and refer to like elements throughout, and in which.

Figure 1A:
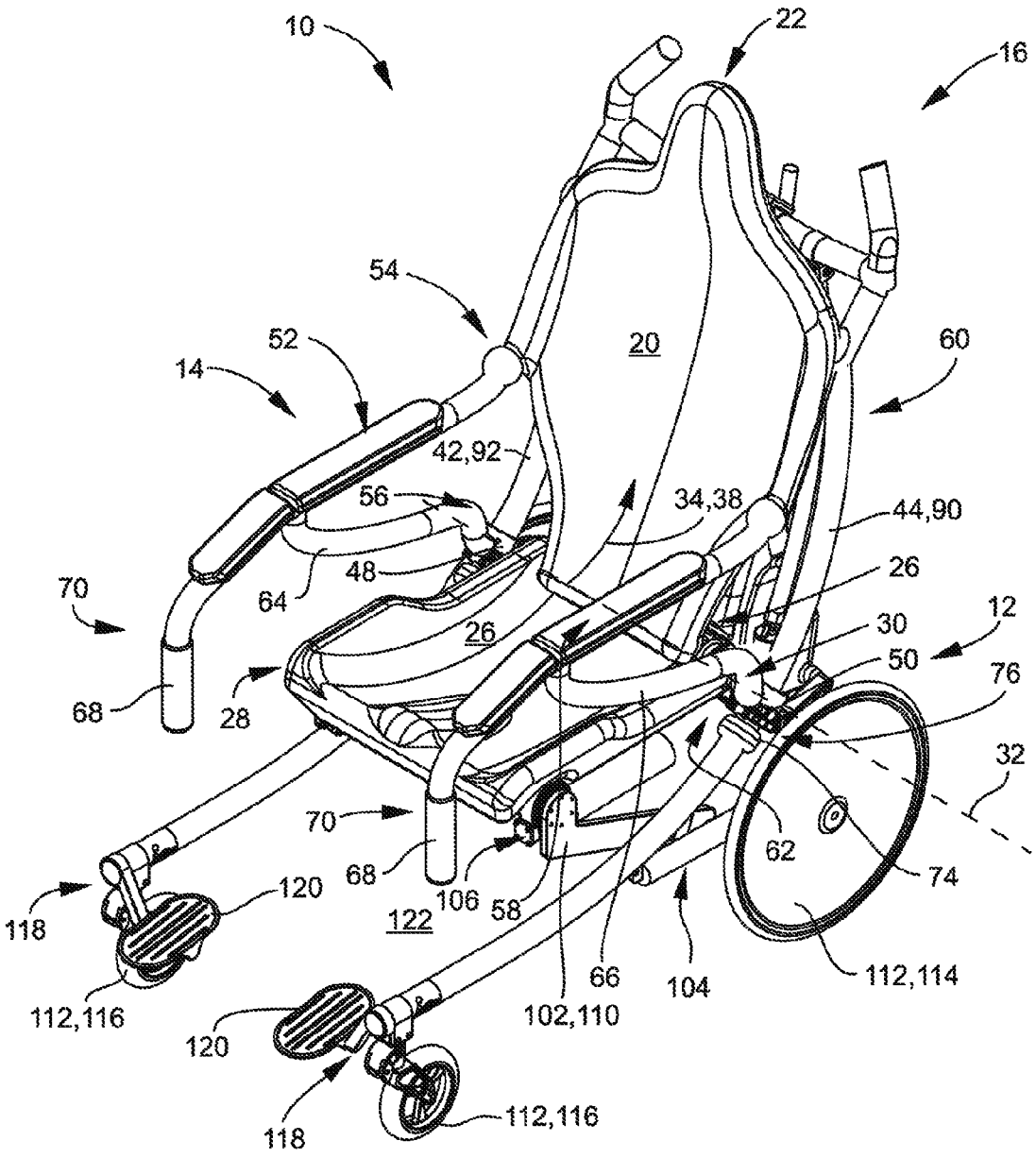
FIG. 1A is a top-front perspective view of an exemplary embodiment of the dynamic seating and walking wheelchair with an active seat with powerlift to stand according to the instant disclosure in the seated position.
Figure 1B:
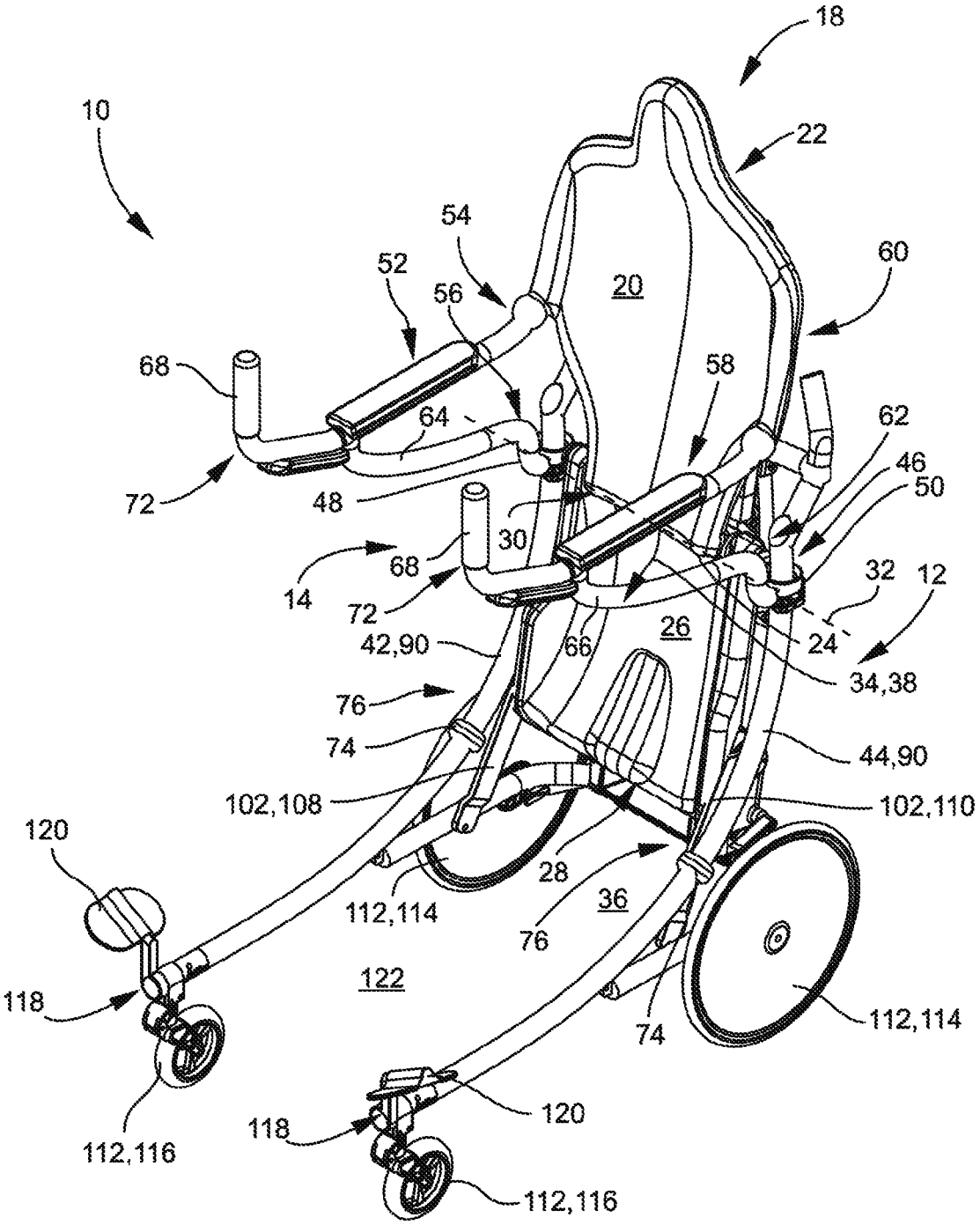
FIG. 1B is a top-front perspective view of the dynamic seating and walking wheelchair with an active seat with powerlift to stand of FIG. 1A in the standing position.
Figure 2A:
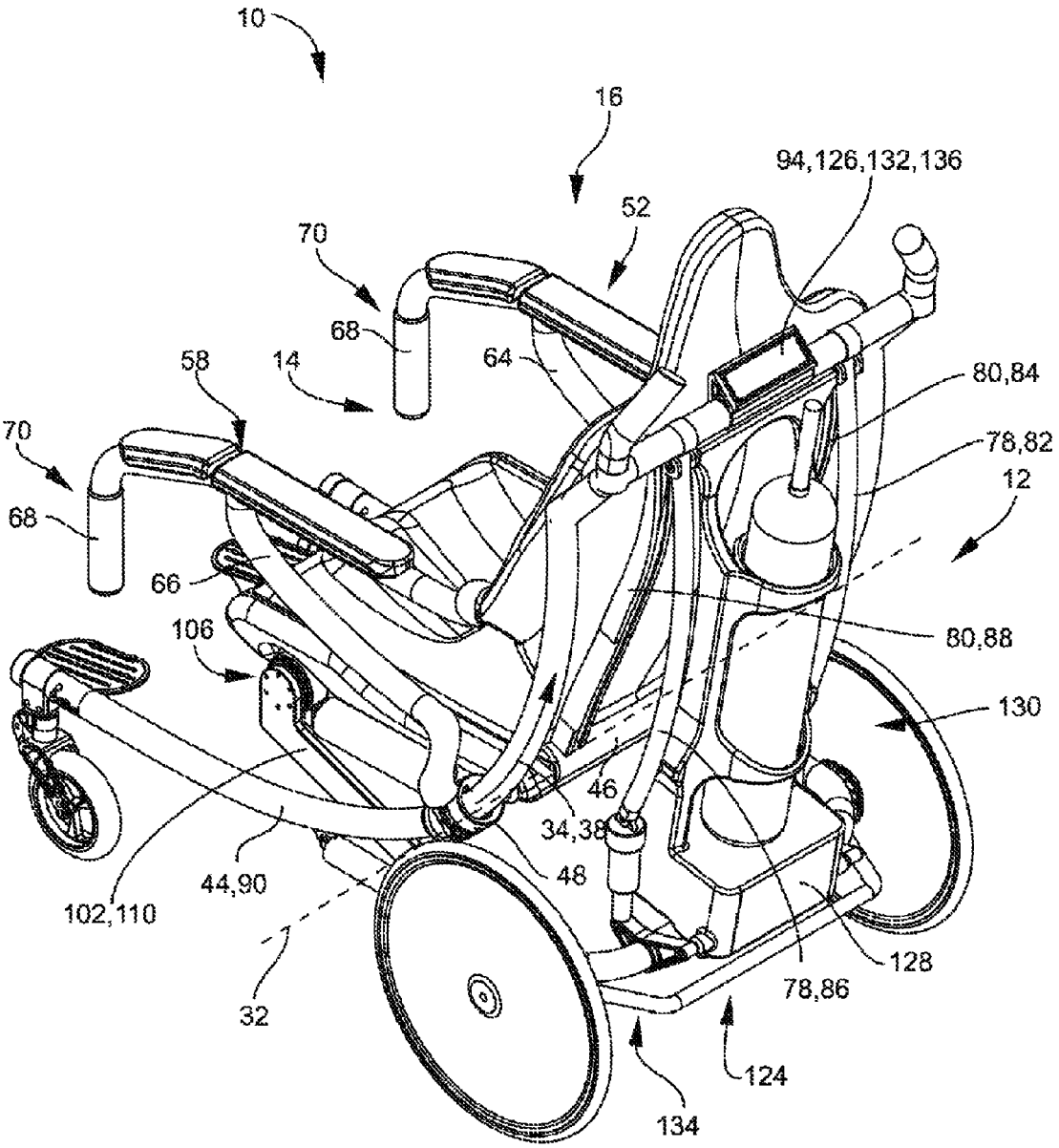
FIG. 2A is a top-back perspective view of the dynamic seating and walking wheelchair with an active seat with powerlift to stand of FIG. 1A in the seated position.
Figure 2B:
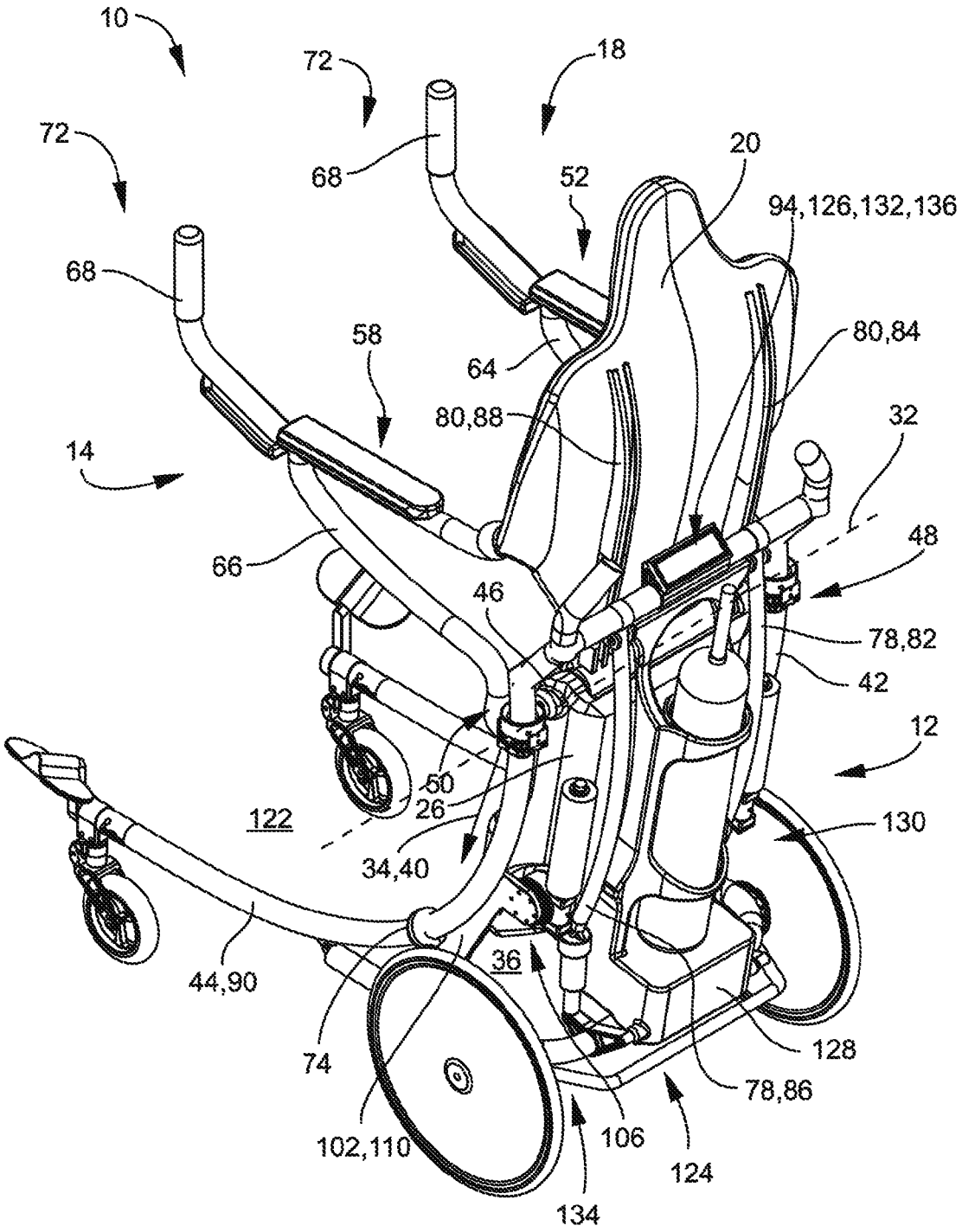
FIG. 2B is a top-back perspective view of the dynamic seating and walking wheelchair with an active seat with powerlift to stand of FIG. 1A in the standing position.
Figure 3A:
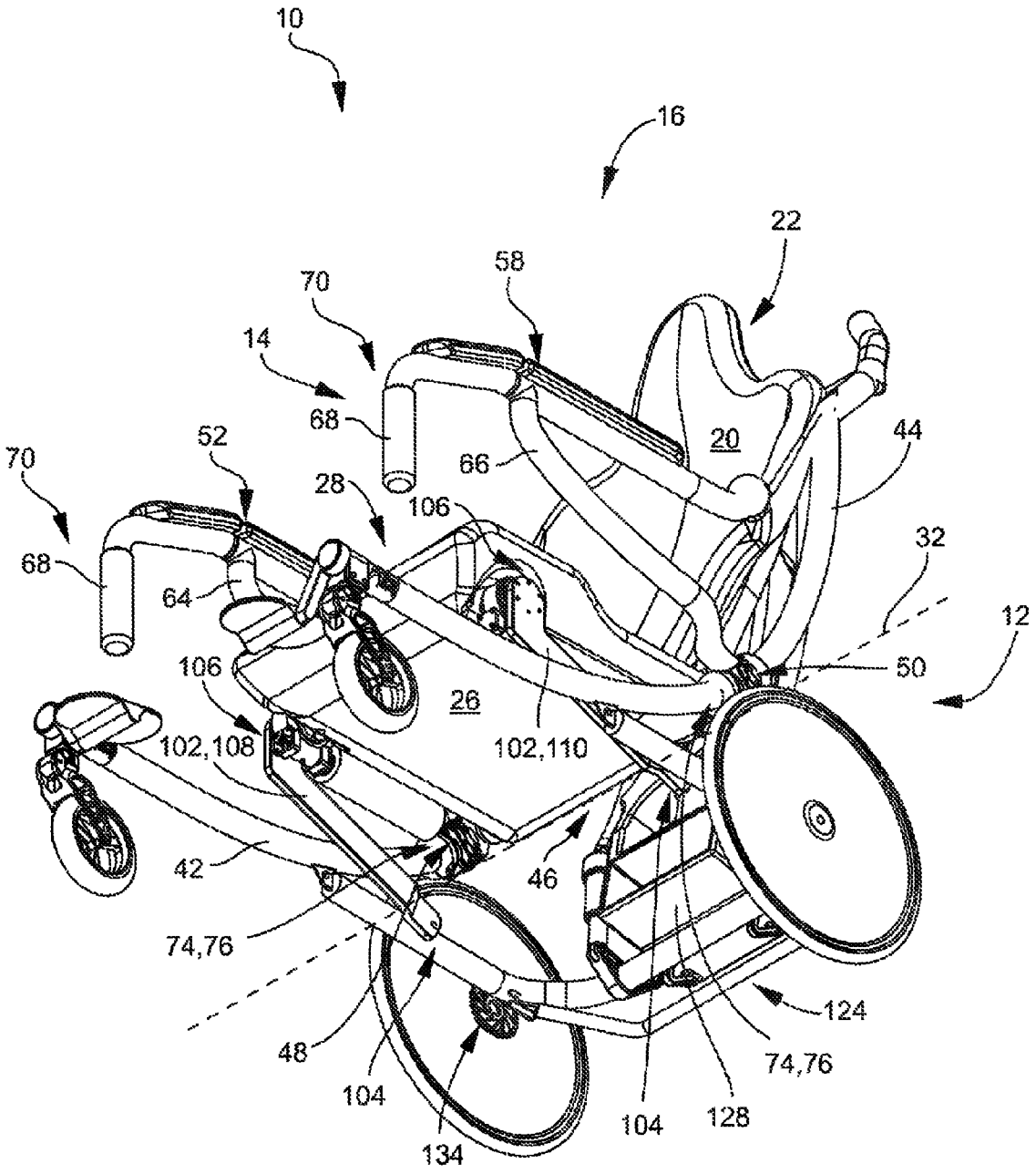
FIG. 3A is a bottom-front perspective view of the dynamic seating and walking wheelchair with an active seat with powerlift to stand of FIG. 1A in the seated position.
Figure 3B:
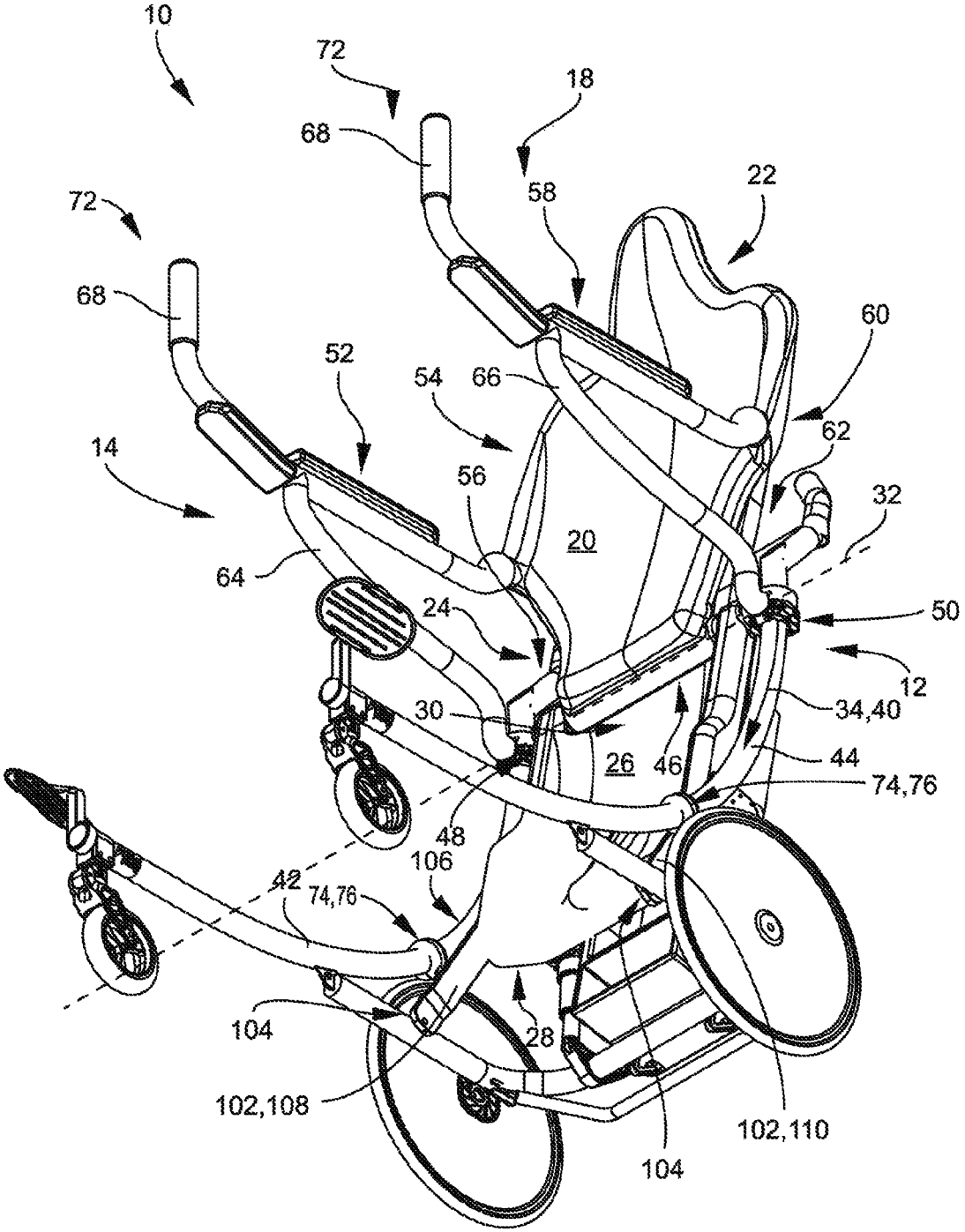
FIG. 3B is a bottom-front perspective view of the dynamic seating and walking wheelchair with an active seat with powerlift to stand of FIG. 1A in the standing position.
Figure 4A:
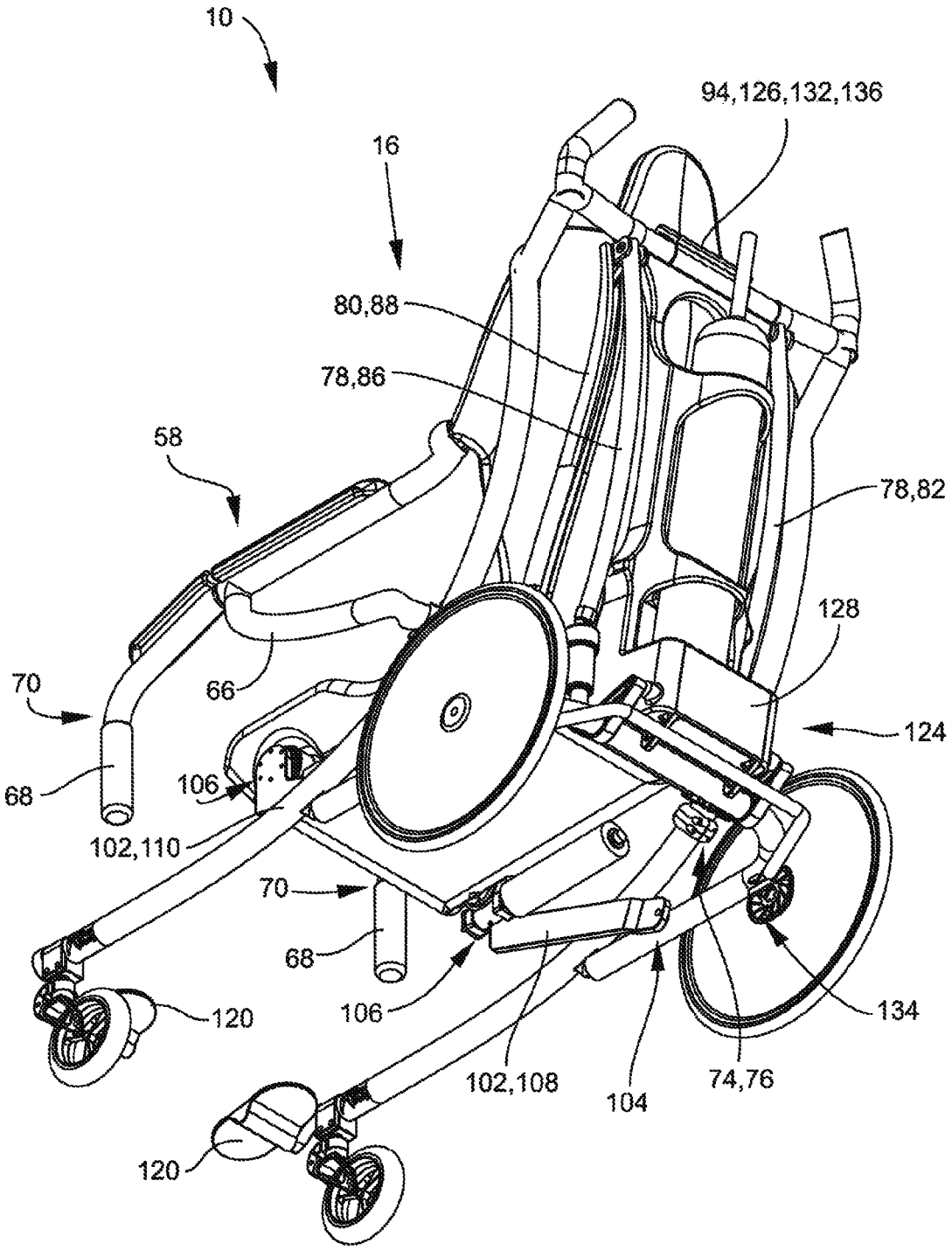
FIG. 4A is a bottom-back perspective view of the dynamic seating and walking wheelchair with an active seat with powerlift to stand of FIG. 1A in the seated position.
Figure 4B:
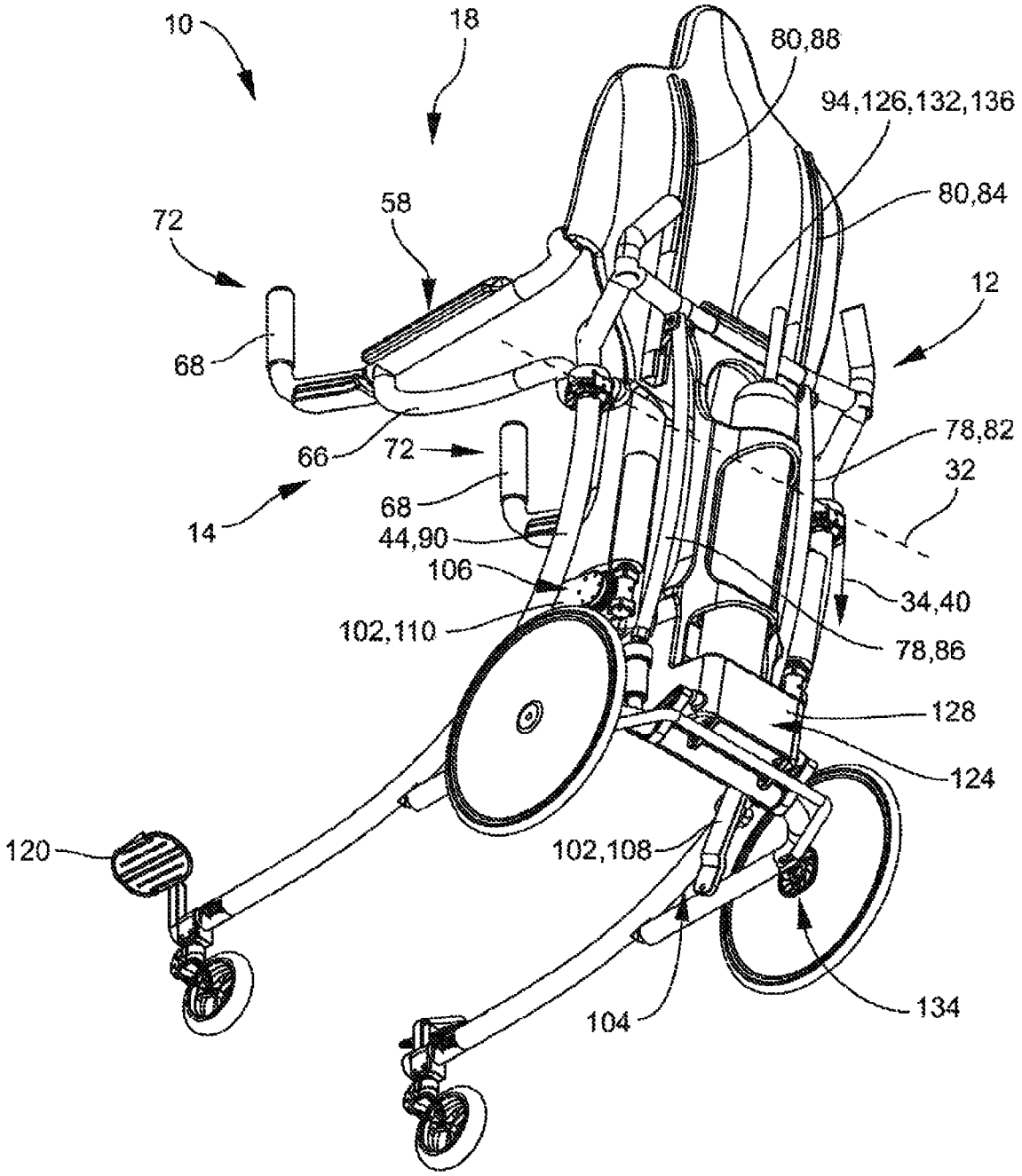
FIG. 4B is a bottom-back perspective view of the dynamic seating and walking wheelchair with an active seat with powerlift to stand of FIG. 1A in the standing position.
Figure 5A:
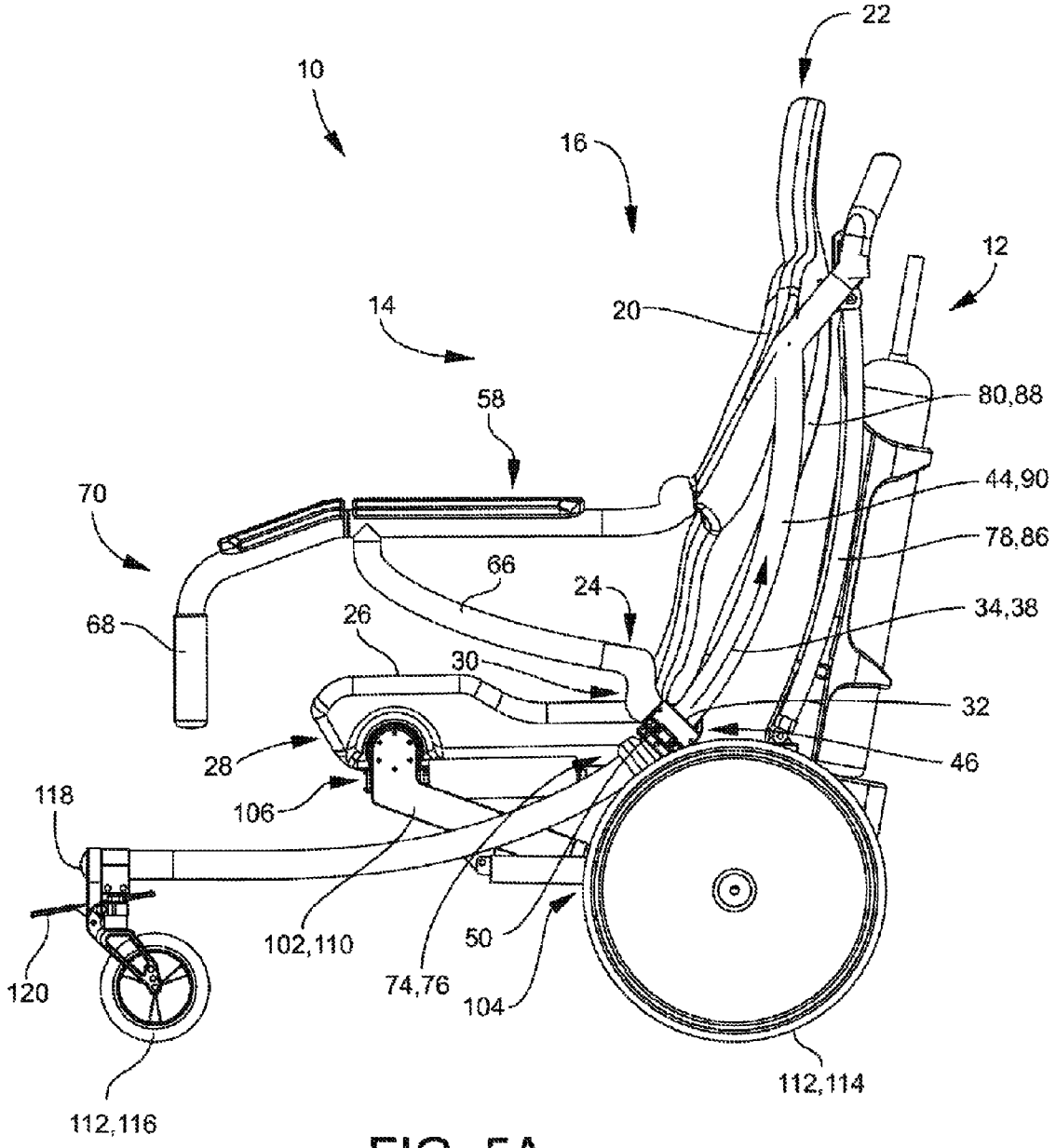
FIG. 5A is a side view of the dynamic seating and walking wheelchair with an active seat with powerlift to stand of FIG. 1A in the seated position.
Figure 5B:
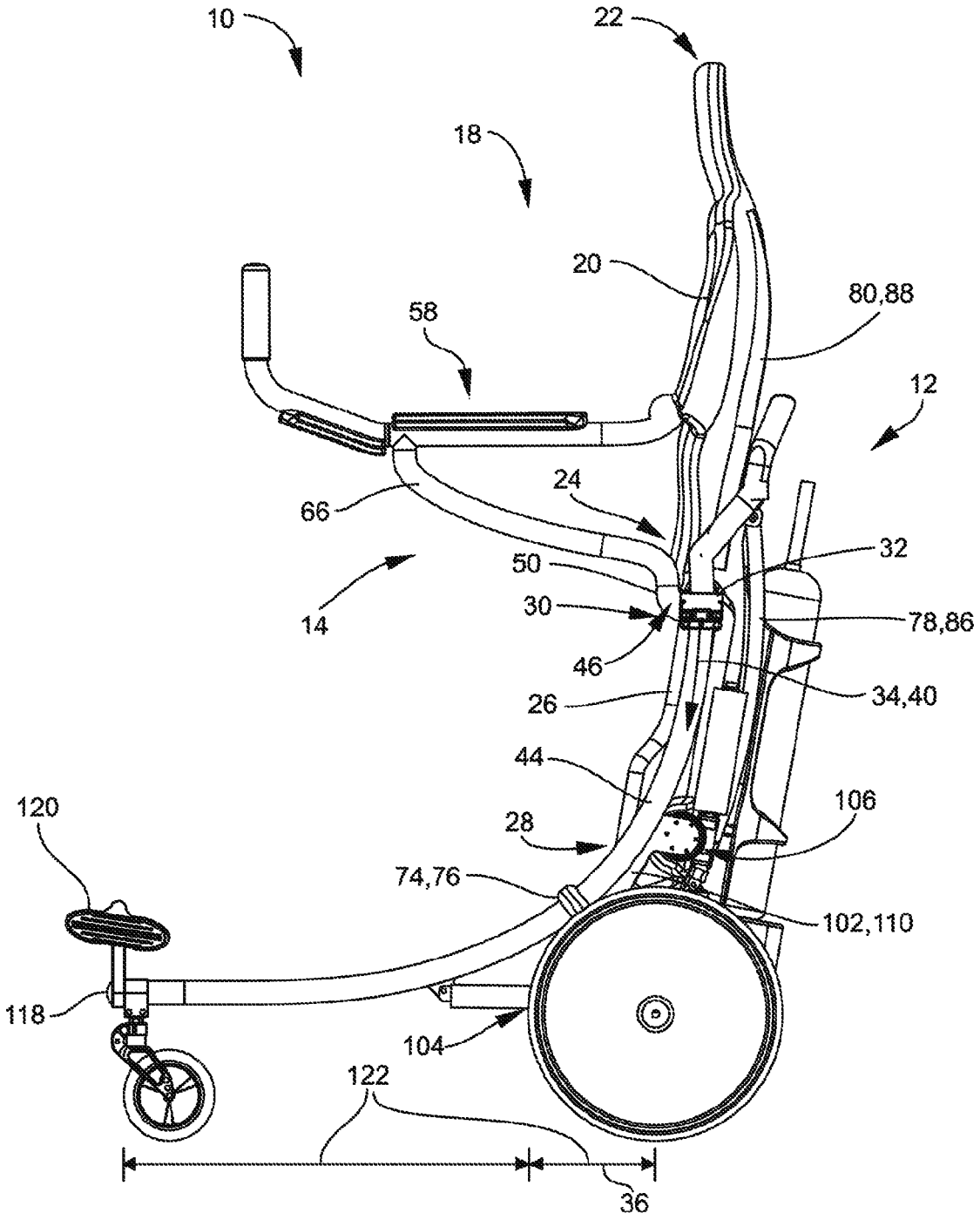
FIG. 5B is a side view of the dynamic seating and walking wheelchair with an active seat with powerlift to stand of FIG. 1A in the standing position.
Figure 6A:
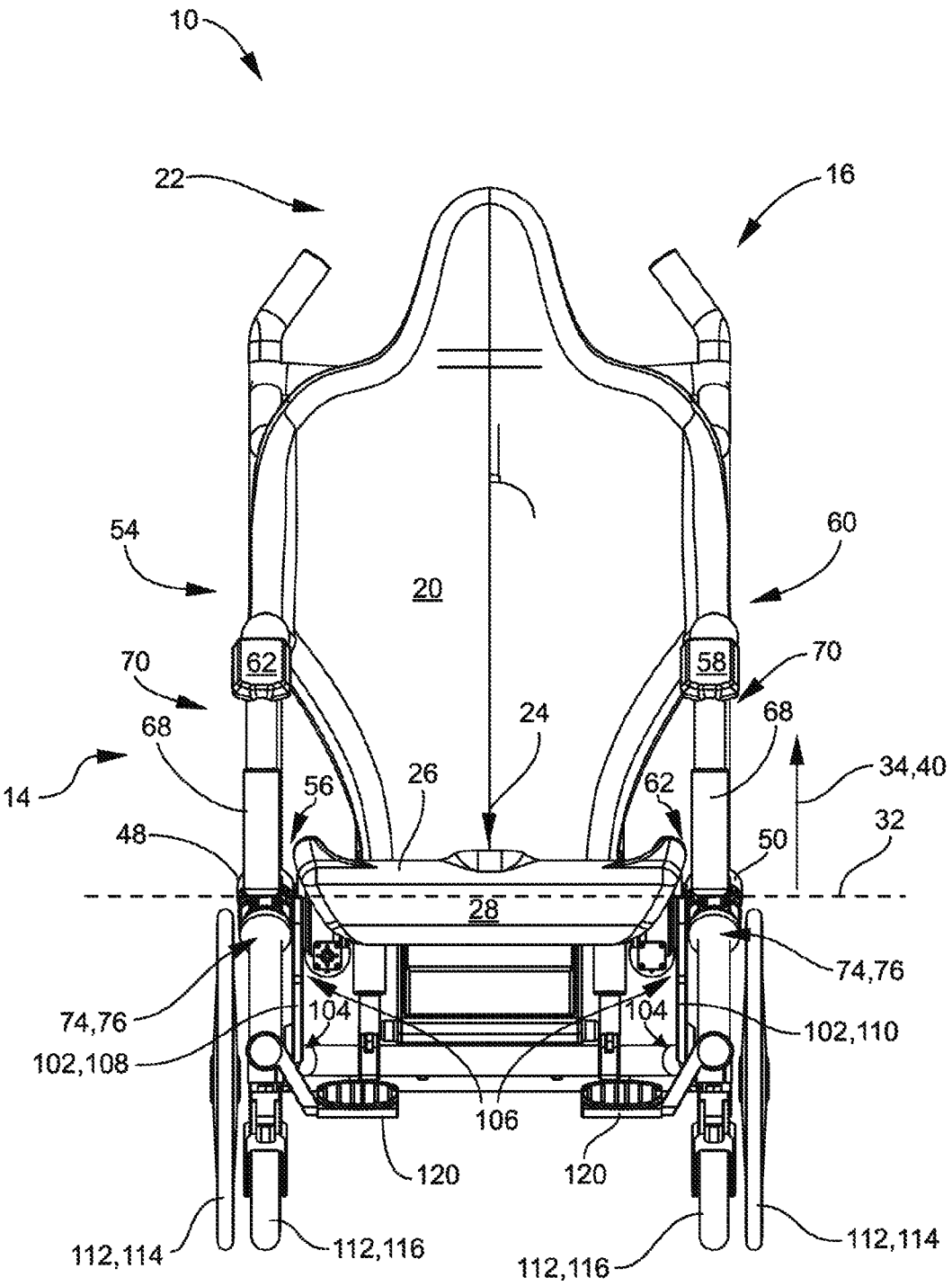
FIG. 6A is a front view of the dynamic seating and walking wheelchair with an active seat with powerlift to stand of FIG. 1A in the seated position.
Figure 6B:
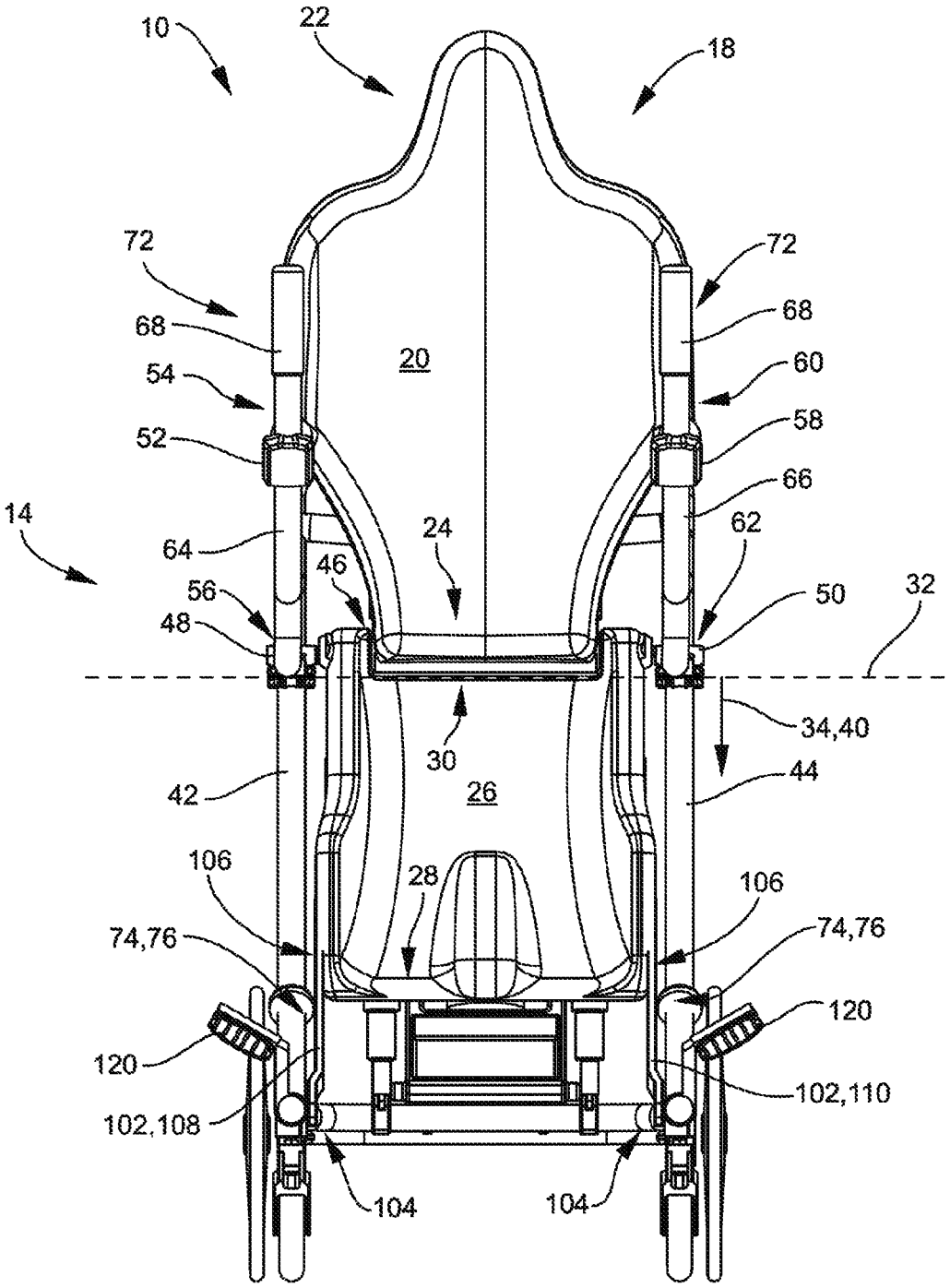
FIG. 6B is a front view of the dynamic seating and walking wheelchair with an active seat with powerlift to stand of FIG. 1A in the standing position.
Figure 7A:
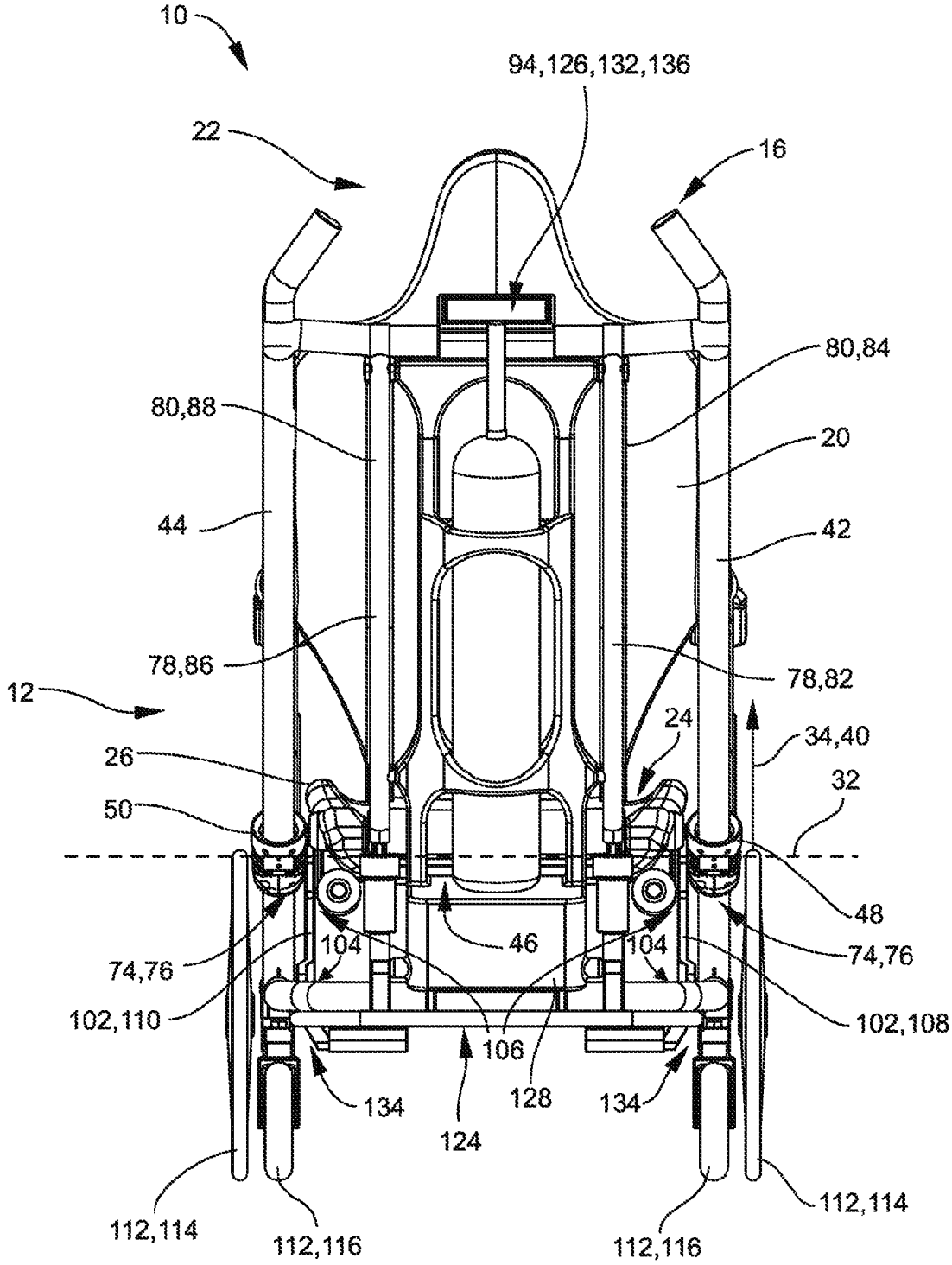
FIG. 7A is a back view of the dynamic seating and walking wheelchair with an active seat with powerlift to stand of FIG. 1A in the seated position.
Figure 7B:
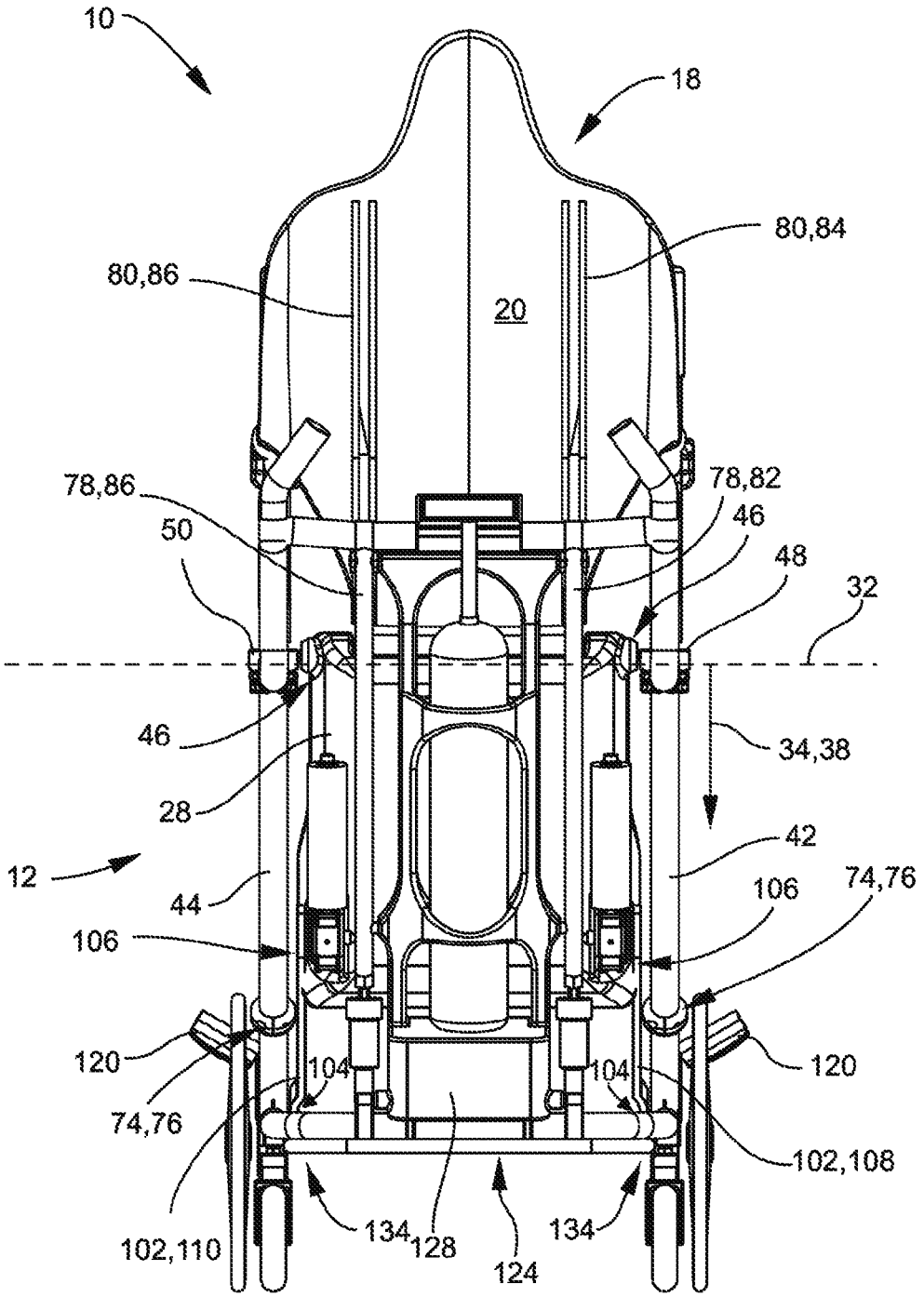
FIG. 7B is a back view of the dynamic seating and walking wheelchair with an active seat with powerlift to stand of FIG. 1A in the standing position.
Figure 8A:
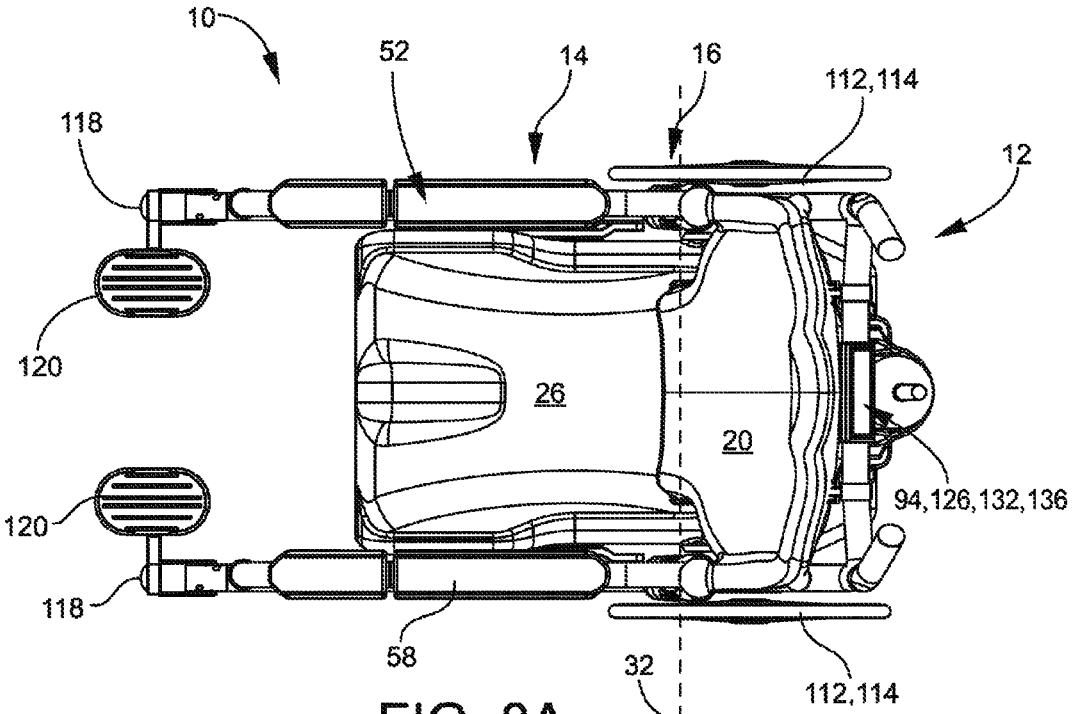
FIG. 8A is a top view of the dynamic seating and walking wheelchair with an active seat with powerlift to stand of FIG. 1A in the seated position.
Figure 8B:
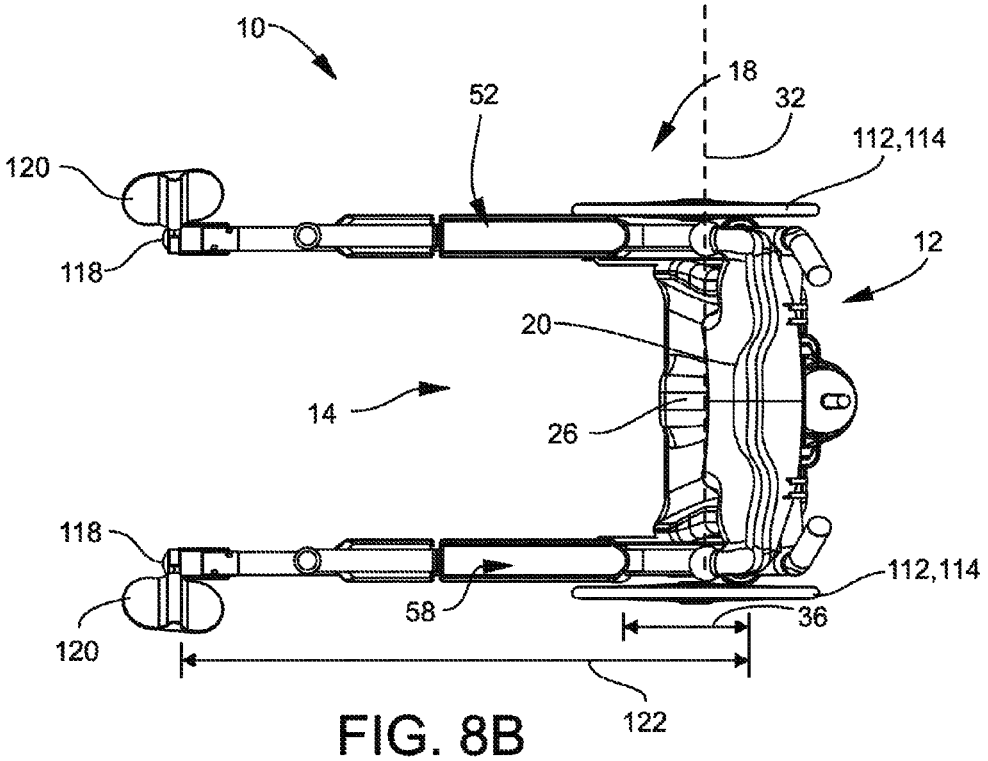
FIG. 8B is a top view of the dynamic seating and walking wheelchair with an active seat with powerlift to stand of FIG. 1A in the standing position.
Figure 9A:
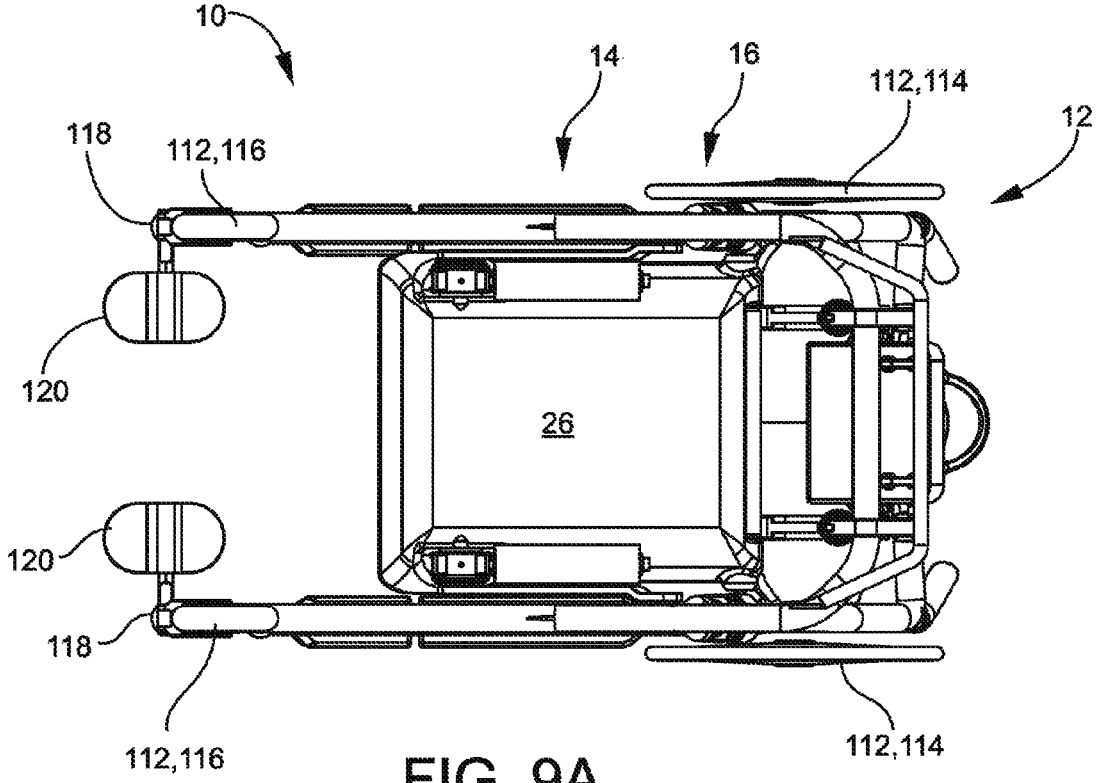
FIG. 9A is a bottom view of the dynamic seating and walking wheelchair with an active seat with powerlift to stand of FIG. 1A in the seated position.
Figure 9B:
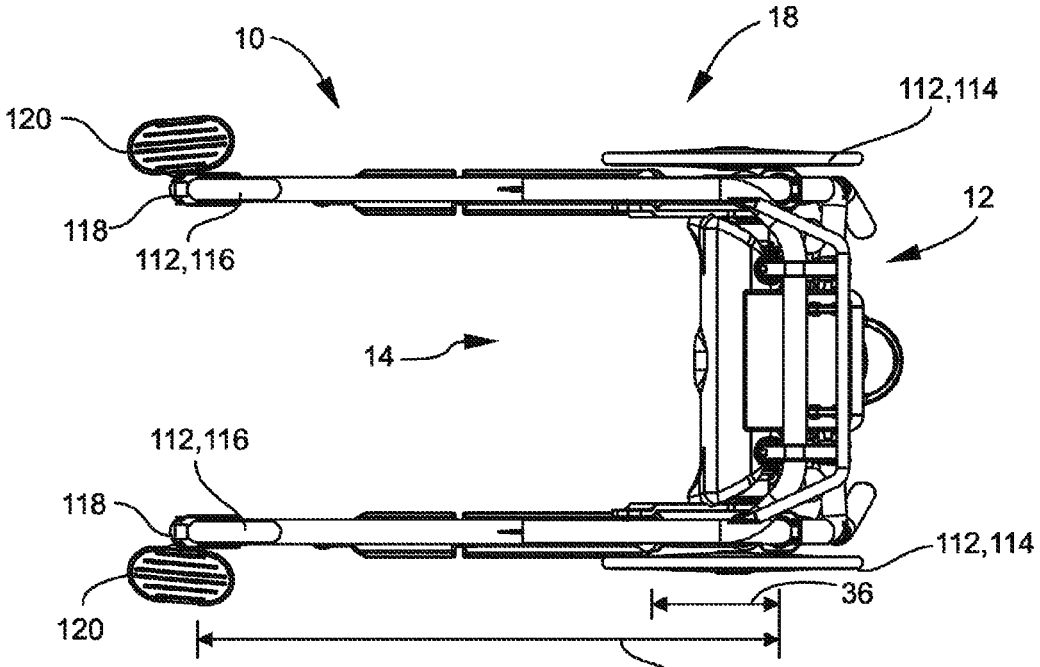
FIG. 9B is a bottom view of the dynamic seating and walking wheelchair with an active seat with powerlift to stand of FIG. 1A in the standing position.
Figure 10:
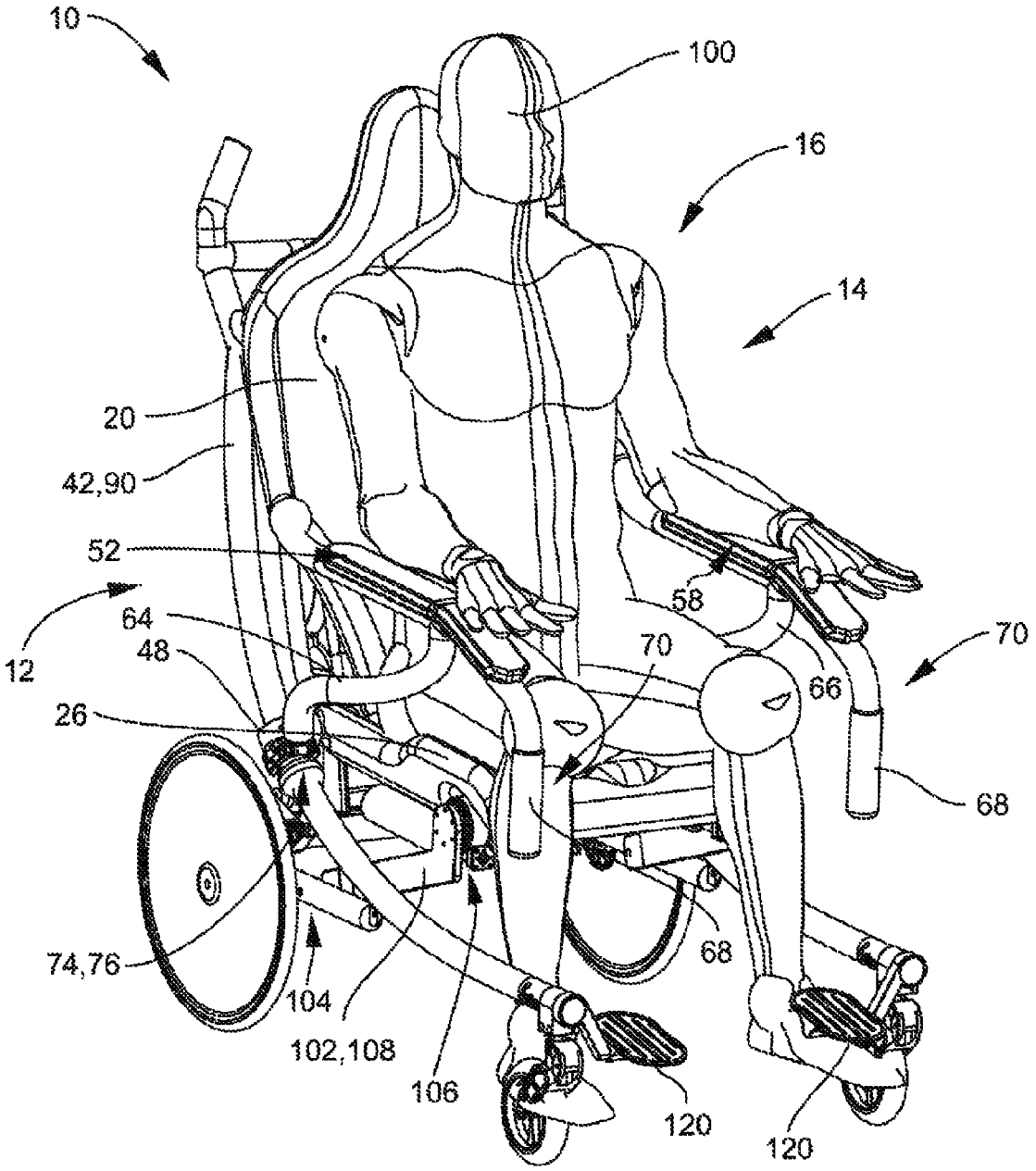
FIG. 10 is a top-front perspective view of an exemplary embodiment of the dynamic seating and walking wheelchair with an active seat with powerlift to stand according to the instant disclosure in the seated position with a human.
Figure 11:
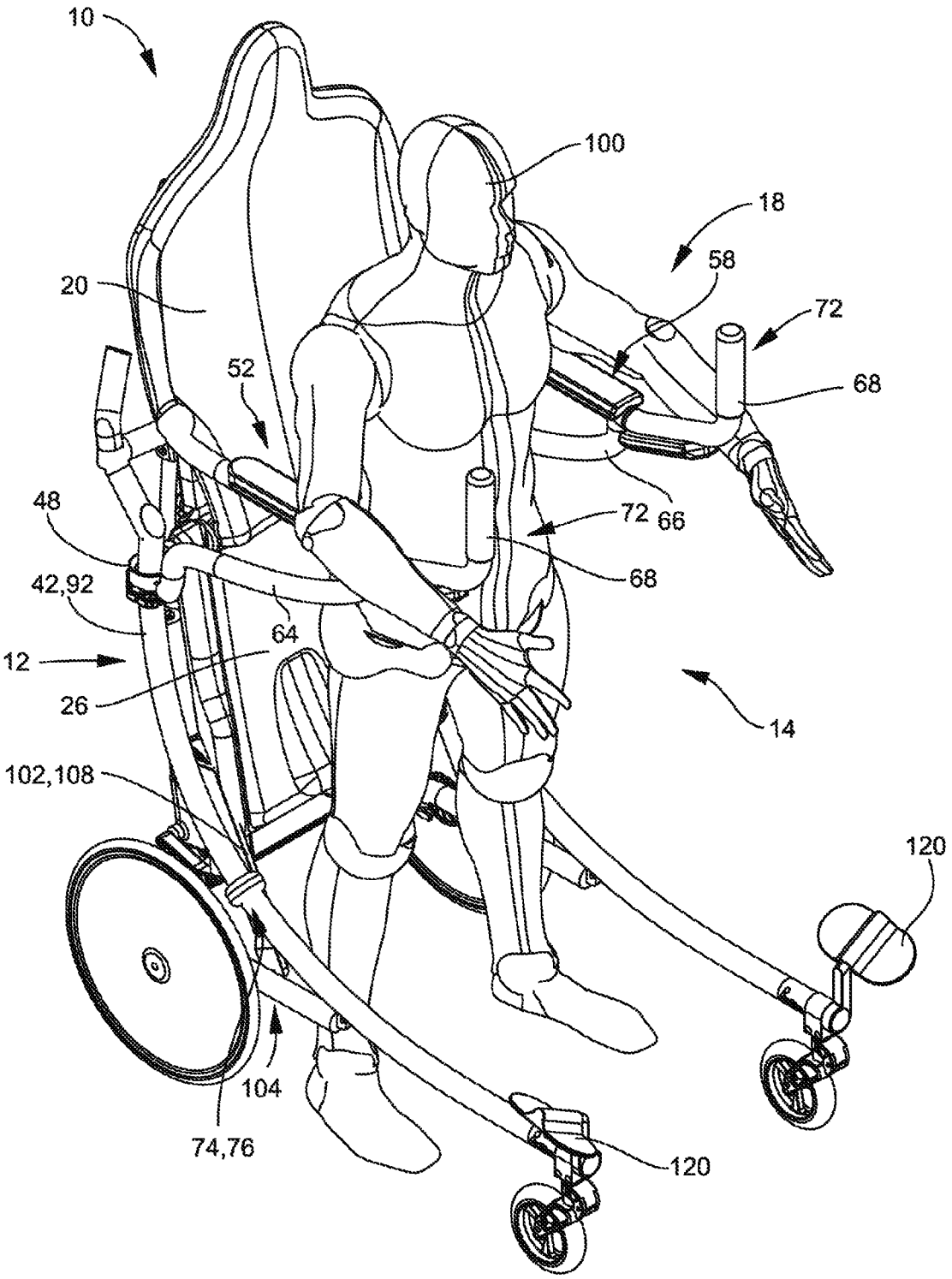
FIG. 11 is a top-front perspective view of an exemplary embodiment of the dynamic seating and walking wheelchair with an active seat with powerlift to stand according to the instant disclosure in the standing position with a human.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-13, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-12 by way of example, and not limitation, therein is illustrated an example embodiment of dynamic seating and walking wheelchair 10 with active seat 12 with powerlift to stand. Dynamic seating and walking wheelchair 10 may be generally described as an assistive device able to be used as a conventional wheelchair with added capabilities, like for use by individuals with limited mobility resulting from a permanent disability or during periods of rehabilitation. Active seat 14 with powerlift to stand of dynamic seating and walking wheelchair may have the functionality of a wheelchair and, with the powerlift to stand, the ability to assist in raising (or lowering) the individual from a seated to standing position (or vice versa), like to facilitate the individual in walking in order to maintain healthy function or during periods of rehabilitation. Wheelchair 10 may provide support to the individual while walking and may provide a specific design to resist tipping which may be useful for walking as well as reaching objects unable to be reached while sitting and providing the opportunity to stand in a normal manner.

As shown in FIGS. 1-12, dynamic seating and walking wheelchair 10 may generally include frame 12 and active seat 14. Frame 12 may be configured to support active seat 14. Active seat 14 may be configured to move from seated position 16 (see FIGS. 1A, 2A, 3A, 4A, 5A, 6A, 7A, 8A and 9A) to walking (or standing) position 18 (see FIGS. 1B, 2B, 3B, 4B, 5B, 6B, 7B, 8B and 9B). Active seat 14 may include seat back 20 and seat bottom 26. Seat back 20 may have upper end 22 and lower end 24. Seat back 20 may be configured to slide up and down on frame 12. seat bottom 26 may have front end 28 and rear end 30. Rear end 30 of seat bottom 26 may be rotatable about movable pivot axis 32 approximate to lower end 24 of seat back 20 from seated position 16 of approximately horizontal to walking/standing position 18 of approximately vertical. Wherein, when active seat 14 moves from seated position 16 to standing/walking position 18, movement 34 of movable pivot axis 32 may be both upwards and backwards.

When active seat 14 with powerlift to stand moves from seated position 16 to standing position 18 and movable pivot axis 32 moves both upwards and backwards, extended walking gait area 36 (see FIGS. 1B, 2B, 5B, 8B, and 9B) may be formed by the backwards movement of movable pivot axis 32. This extended walking gait area 36 provided by the backwards movement of seat bottom 26 on movable pivot axis 32 provides user 100 with additional area for standing, walking and maneuvering of and in dynamic seating and walking wheelchair 10. Other devices exist that provide the user the ability to raise to a standing position, however, the corresponding component base of seat bottom 26 of wheelchair 10 may be parallel and close to the user and forward of the vertical plane from where seat bottom 26 and seat back 20 intersect while standing eliminating the ability to walk or causing an obstruction with the legs of user 100 while attempting to walk which could result in additional instability and limit the intended support for both permanent use and rehabilitation.

When active seat 14 moves from seated position 16 to standing/walking position 18, movement 34 of moveable pivot axis 32 that is both upwards and backwards may be in curved motion 38 or linear motion 40. As shown in the example embodiments of FIGS. 1-9, movement 34 of moveable pivot axis 32 that is both upwards and backwards may be in curved motion 38.

Frame 12 may generally include any parts, devices, configurations, or combinations thereof for supporting active seat 14 an allowing active seat 14 to move back and forth from seated position 16 to standing position 18. In select embodiments, frame 12 may generally include left rail 42, right rail 44, and bracket 46. Rails, like left rail 42 and/or right rail 44, as used herein, may be any device or member that bracket 46 may slide or move up and down on, including, but not limited to, any rails, tracks, channels, lines, brackets, slides, grooves, tubes, the like, etc. Bracket 46 may interconnect left rail 42 and right rail 44 via left slide 48 on its left end 56 moveable about left rail 42, and right slide 50 on its right end 62 moveable about right rail 44. Slides, like left slide 48 and/or right slide 50, as used herein, may be any devices capable of moving, sliding, tracking, etc. up and down on left and right rails 42 and 44, including, but not limited to, any slides, guides, grooves, channels, wheels, bearings, sleeves, the like, etc. Bracket 46 may support rear end 30 of seat bottom 26 and may allow seat bottom 26 to rotate about movable pivot axis 32 from seated position 16 of approximately horizontal to walking/standing position 18 of approximately vertical as bracket 46 moves upwards and backwards along left and right rails 42 and 44. As shown in the Figures, bracket 46 may be built into rear end 30 of seat bottom 26. In select embodiments, left and right rails 42 and 44 may include stops 74. Stops 74 may be positioned at location 76 on rails 42 and 44 corresponding to seated position 16 for stopping the corresponding left and right slides 48 and 50 on the rails 42 and 44 from going below seated position 16. Stops 74 may be any fixed device or devices for preventing bracket 46 from going below seated position 16. In select embodiments, stops 74 may be adjustable for adjusting the positioning of seated position 16. In other select embodiments, stops 74 may include a cushion or spring for softening the slowdown of bracket 46 on rails 42 and 44 as it approaches seated position 16.

Dynamic seating and walking wheelchair 10 with active seat 14 with powerlift to stand may contain structures to help support the arms of user 100 and for user 100 to grasp in stabilizing themselves while standing or walking. Wheelchair 10 may also include safety straps used to support the user in the event the user was unable to support their weight or where the user requires some support during a period of rehabilitation or permanently. In select embodiments, an apparatus may be located above seat back 20 that raises with seat back 20 that can be attached to a sling that may be located under user 100. In this embodiment, as active seat 14 raises, the entire body of user 100 may be lifted (the raise essentially doubles as a patient lift). In this mode, the armrests may be configured to move out of the way for full access to move the user 100 over the edge of a bed for transfer to or from the bed. In select embodiments, at least one armrest may be included in select embodiments of frame 12 of dynamic seating and walking wheelchair 10. In select embodiments, frame 12 may include left armrest 52 and right armrest 58. Left armrest 52 may extend from left side 54 of seat back 20 and may interconnect left side 54 of seat back 20 with left side 56 of bracket 46. Right armrest 58 may extend from right side 60 of seat back 20 and may interconnect right side 60 of seat back 20 with right side 62 of bracket 46. As shown in the Figures, left and right armrests 52 and 58 may include left and right under supports 64 and 66, respectively, for supporting weight on the armrests. With this configuration of the armrests 52 and 58 interconnecting seat back 20 with bracket 46, when bracket 46 moves seat bottom 26 from seated position 16 to walking/standing position 18 in an upward and backward motion 34, seat back 20 may move in a corresponding upward and backward motion. In select embodiments, armrests 52 and 58 may include rotating grips 68 at their distal ends. Rotating grips may be rotatable from downward position 70 for seated position 16, to an upward or angled position 72 for standing/walking position 18. In other select embodiments of armrests 52 and 58, at least one of armrests 52 and 58, or both, may rotate from its straight position allowing for easier exit and entry by user 100. In yet other select embodiments, armrests 52 and/or 58 may provide connecting points to add a harness for additional support while standing or walking.

At least one seat back support 78 and seat back track 80 fixed to the seat back for each seat back support may be includes in select embodiments of frame 12 of dynamic seating and walking wheelchair 10 (see FIGS. 2A, 2B, 4A, 4B, 5A, 5B, 7A, and 7B). Each seat back support 78 may be configured to support seat back 20 via moving within the corresponding seat back track 80 when moving upwards and backwards from seated position 16 to standing/walking position 18. In select embodiments, each of seat back supports 78 may be pivotally fixed to frame 12 for allowing the backwards motion and/or for allowing of adjustment of seat back 20. As such, each of seat back supports 78 may be configured for adjustment in seated position 16 by adjusting the angle of the seat back 20 with seat bottom 26. In select embodiments, frame 12 may include two seat back supports 78 (left seat back support 82 and right seat back support 86) and two seat back tracks 80 (left seat back track 84 and right seat back track 88). As shown in the Figures, left seat back support 82 may be pivotally connected to the left side of frame 12 and may be configured to support seat back 20 via moving within left seat back track 84 when moving upwards and backwards from seated position 16 to standing/walking position 18. Likewise, right seat back support 86 may be pivotally connected to the right side of frame 12 and may be configured to support seat back 20 via moving within right seat back track 88 when moving upwards and backwards from seated position 16 to standing/walking position 18. In another non limiting embodiment, wheelchair 10 may be used to adjust seated position 16 of user 100 based on personal preference as well as to minimize point forces with the skin that lead to health complications of users needing a wheelchair for extended periods of time. Additionally, wheelchair 10 can be used to assist care givers with lifting user 100 from the device for transition to another position.

As shown in the FIGS. 1-12, in select embodiments, when active seat 14 moves from seated position 16 to standing/walking position 18, where movable pivot axis 32 moves both up and back in curved motion 38, left and right rails 42 and 44 may be curved rails 90. However, the invention is not so limited to the curved embodiments shown in the Figures, and any other embodiments that provide upwards and backwards movement of movable pivot axis 32 may be provided. As another example, when active seat 14 moves from seated position 16 to standing/walking position 18, movable pivot axis 32 may move both up and back in linear motion 40. In this linear motion 40 embodiment, left and right rails 42 and 44 may be angled rails.

Figure 12:
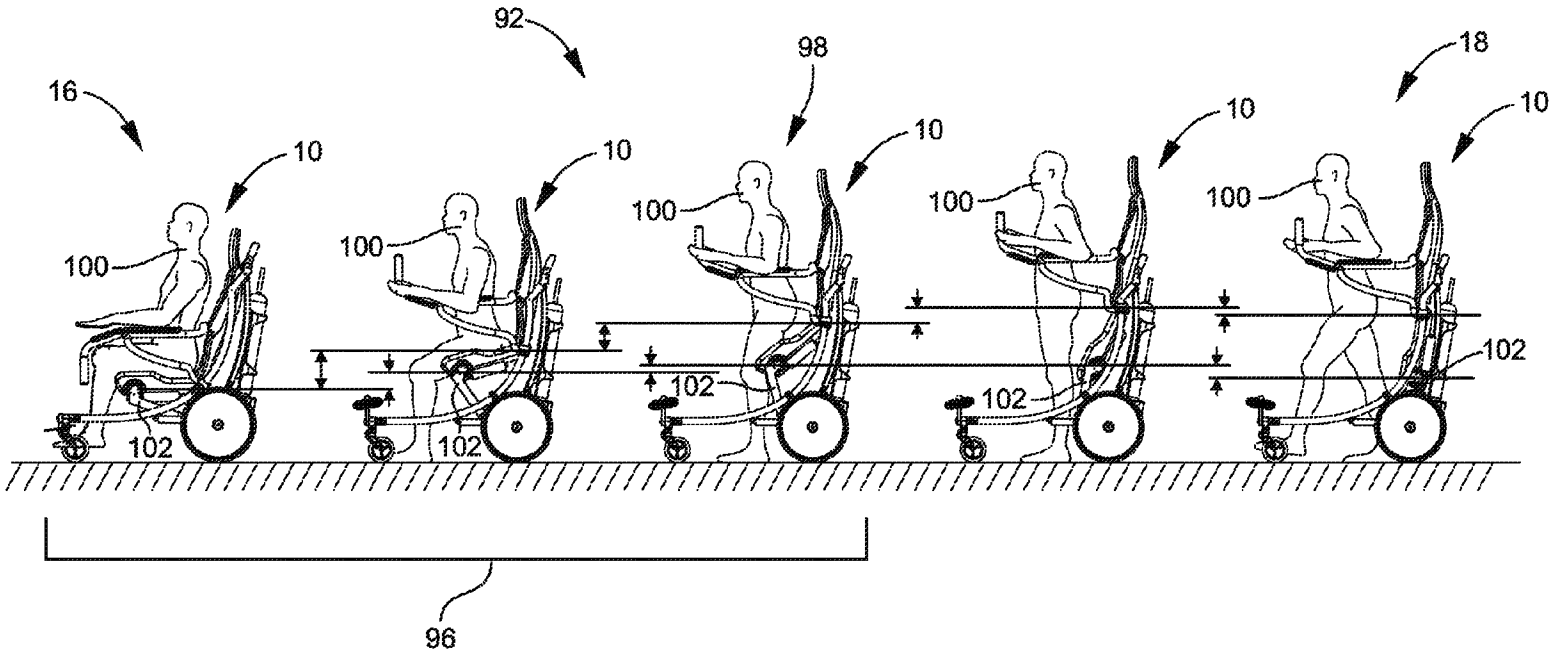
FIG. 12 is a side view of an exemplary embodiment of the dynamic seating and walking wheelchair with an active seat with powerlift to stand according to the instant disclosure with a human moving from the seated position to the standing position.

Referring now to FIG. 12, one feature of dynamic seating and walking wheelchair 10 may be that when active seat 14 moves from seated position 16 to standing/walking position 18, active seat 14 may provide change 92 of seating heights and/or support angles from seated position 16 to walking/standing position 18. In select embodiments, wheelchair 10 may have incremental adjustments control 94 which yield different seat heights without the necessity of providing full standing positioning (see FIGS. 2A, 2B, 4A, 4B, 7A, 7B and 8A). Although the Figures show incremental adjustments control 94 for controlling the adjustments on a control panel on the rear of wheelchair 10, the invention is not so limited and incremental adjustments control 94 may be placed anywhere on wheelchair 10, including where user 100 has access to incremental adjustments control 94, like on armrests 52 and/or 58. In select embodiments, incremental adjustments control 94 may be on the control panel behind the wheel chair and within access to user 100, where incremental adjustments control 94 within access to user 100 may be disengaged by the control panel.

Again referring to FIG. 12, one feature of dynamic seating and walking wheelchair 10 may be that when active seat 14 moves from seated position 16 to standing/walking position 18, front end 28 of seat bottom 26 may raise for initial portion 96 of the movement from seated position 16 to standing/walking position 18. In select embodiments, front end 28 of seat bottom 26 may raise at slower rate 98 than rear end 30 of seat bottom 26, thereby providing angled support from seat bottom 26 for user 100 in coming to a stand. As shown in FIG. 12, this angled support from seat bottom 26 may generally match the movement of the legs of user 100 in coming to a stand.

In addition to its other benefits noted earlier, dynamic seating and walking wheel chair 10 provides a mechanism by which a handicapped person may routinely undertake therapy and rehabilitative gait training without the necessity of other specialized equipment and with a minimal amount of assistance. This disclosure allows the user to enjoy a large range of seating and standing positions, including, among other movement, the user to place their feet on the floor and extend his or her legs at various angles up to and including the locked standing position. The user is thus able to make postural adjustments which provide relief from the discomfort and pain which otherwise results when one is unable to make unconscious body movements or postural adjustments.

Frame 12 may include any various parts, devices, configurations or combinations thereof for front end 28 of seat bottom 26 rising for initial portion 96 of the movement from seated position 16 to standing/walking position 18 and/or providing angled support from seat bottom 26 for user 100 in coming to a stand. In select embodiments, frame 12 may include at least one seat bottom lever 102. Seat bottom lever 102 may be for raising front end 28 of seat bottom 26 for at least initial portion 96 of the movement from seated position 16 to standing/walking position 18. Seat bottom lever 102 may be rotatably connected to frame 12 at one end 104 and rotatably connected to front end 28 (or approximate thereto) of seat bottom 26 at its other end 106. Wherein, when active seat 14 moves from seated position 16 to walking/standing position 18, seat bottom lever 102 may raise front end 28 of seat bottom 26 for initial portion 96 of the movement. In select embodiments, frame 12 may include two seat bottom levers 102, left seat bottom lever 108 and right seat bottom lever 110. Left seat bottom lever 108 may be rotatably connected to the left side of frame 12 at one end 104 and rotatably connected to the left side of front end 28 of seat bottom 26 at its other end 106. Likewise, right seat bottom lever 110 may be rotatably connected to the right side of frame 12 at one end 104 and rotatably connected to the right side of front end 28 of seat bottom 26 at its other end 106. Seat bottom levers 102 may have an angle of greater than 90 degrees when in the seated position. This configuration may allow front end 28 of seat bottom 26 to raise for initial portion 96 until the angle reaches 90 degrees. At this 90 degrees point, an intermediate position between seated position 16 and standing/walking position 18, front end 28 of seat bottom 26 does not raise anymore and will begin to fall. This intermediate position may be configured to be at any point in the process between seated position 16 and standing/walking position 18.

Wheels 112 may be included in select embodiments of dynamic seating and walking wheelchair 10 on frame 12. Frame 12 may include any number of wheels 112 and configuration of wheels 112, including four wheels 112 as shown in the Figures: two rear wheels 114; and two front wheels 116. In select embodiments, two rear wheels 114 may be larger than two front wheels 116. In other select embodiments, front wheels 116 may be positioned at end 118 of each rail 42 and 44 and/or may be rotatable. However, the invention is not so limited and wheelchair 10 may also be used without wheels as a therapeutic device.

Rotatable feet supports 120 may be included in select embodiments of dynamic seating and walking wheelchair 10 on frame 12. Rotatable feet supports 120 may be configured to rotate out of gait area 122 for standing and/or walking. In select embodiments, rotatable feet supports 120 may be positioned at end 118 of each rail 42 and 44.

The transition of user 100 from seated position 16 to walking/standing position 18 can be achieved by the use of powered source 124 or non-powered source, like user 100. Such powered source 124 may include, but are not limited to electric motors, mechanical linkages, and hydraulic power, compressed gas. Such non-powered source may include, but is not limited to, by a person assisting the user and/or user 100 itself. The device may also be transitioned by any combination of powered and non-powered sources. Power source 124 may be for raising active seat 14 from seated position 16 to standing/walking position 18. As shown in the Figures, in select embodiments, wheelchair 10 may further include lifting controls 126 for raising and lowering active seat 14 to and from seated position 16 and standing/walking position 18 (see FIGS. 2A, 2B, 4A, 4B, 7A, 7B and 8A). Although the Figures show lifting controls 126 on a control panel on the rear of wheelchair 10, the invention is not so limited and lifting controls 126 may be placed anywhere on wheelchair 10, including where user 100 has access to lifting controls 126, like on armrests 52 and/or 58. In select embodiments, lifting controls 126 may be on the control panel behind the wheel chair and within access to user 100, where lifting controls 126 within access to user 100 may be disengaged by the control panel. In select embodiments, frame 12 may further include housing 128 for power source 124, and lifting device 130 for transferring the energy from power source 124 to active seat 14 for raising and lowering active seat 14 to and from seated position 16 and standing/walking position 18. In select embodiments, lifting device 130 may include a linear actuator and electric motor. In other embodiments, lifting device 130 may include a rotary actuator and electric motor. In other select embodiments, power source 124 may also power the movement of wheelchair 10, like via its wheels 112 (like via the rear wheels 114). In these powered embodiments, dynamic seating and walking wheelchair 10 may further include movement controls 132 for maneuvering wheelchair 10 (see FIGS. 2A, 2B, 4A, 4B, 7A, 7B and 8A). Although the Figures show movement controls 132 on a control panel on the rear of wheelchair 10, the invention is not so limited and movement controls 132 may be placed anywhere on wheelchair 10, including where user 100 has access to movement controls 132, like on armrests 52 and/or 58. In select embodiments, movement controls 132 may be on the control panel behind the wheel chair and within access to user 100, where movement controls 132 within access to user 100 may be disengaged by the control panel.

Braking mechanism 134 may be included in select embodiments of dynamic seating and walking wheelchair 10. Braking mechanism 134 may be for stopping wheelchair 10 and/or for preventing wheelchair 10 from moving. In select embodiments, braking mechanism 134 may automatically engage upon movement of active seat 14 to and from seated position 16 and standing/walking position 18.

In another non-limiting embodiment, dynamic seating and walking wheelchair 10 with active seat 14 with powerlift to stand may contain straps or supports that would prevent the person from falling in the vent they suddenly where unable to support themselves.

In another non-limiting embodiment, the base of wheelchair 10 may contain means to guard against dynamic wheelchair 10 collapsing or falling over due to user 100 standing, walking or becoming unstable therefore providing a supportive base.

In another non-limiting embodiment, dynamic seating and walking wheelchair 10 can be used in substitution of a walking aide which often restricts the normal walking motion of the user and requires the user to lift the device as they move in particular directions. For example, in a traditional walker the user lifts the walker which has the risk of instability and the user, not only having to support their own weight, but the added weight of the walker, then moves the walker forward in an extended position, then walks one step, then repeats the process. Similarly, walkers with rolling assist often roll away for the user leading to falls and accidental injury associated with the use of the device.

In yet another embodiment, odometer 136 may be included on dynamics seating and walking wheelchair 10. Odometer 136 may be for recording the movement of wheelchair 10, like movement of wheelchair 10 when active seat 14 is in standing/walking position 18, i.e. when user 100 is walking. Odometer 136 may be included anywhere on wheelchair 10 for recording the movement of user 100, including having a display on the control panel at the rear of wheelchair, as shown in FIGS. 2A, 2B, 4A, 4B, 7A, 7B and 8A.

In use, a method of lifting active seat 14 of wheelchair 10 from seated position 16 to walking/standing position 18 may be providing utilizing any of the various embodiments of dynamic seating and walking wheelchair 10, as shown and/or described herein. This method may generally include the steps of: providing frame 12 configured to support active seat 14; moving seat back 20 of active seat 14 with upper end 22 and lower end 24 up and down on frame 12; rotating seat bottom 26 with front end 28 and rear end 30, where rear end 28 of seat bottom 26 is rotatable about movable pivot axis 32 approximate to lower end 24 of seat back 20 from seated position 16 of approximately horizontal to walking/standing position 18 of approximately vertical; and (a) moving movable pivot axis 32 at rear end 30 of seat bottom 26 both upwards and backwards, and/or (b) moving front end 28 of seat bottom 26 up for initial portion 96 of movement 34 from seated position 16 to standing/walking position 18.

Figure 13A:
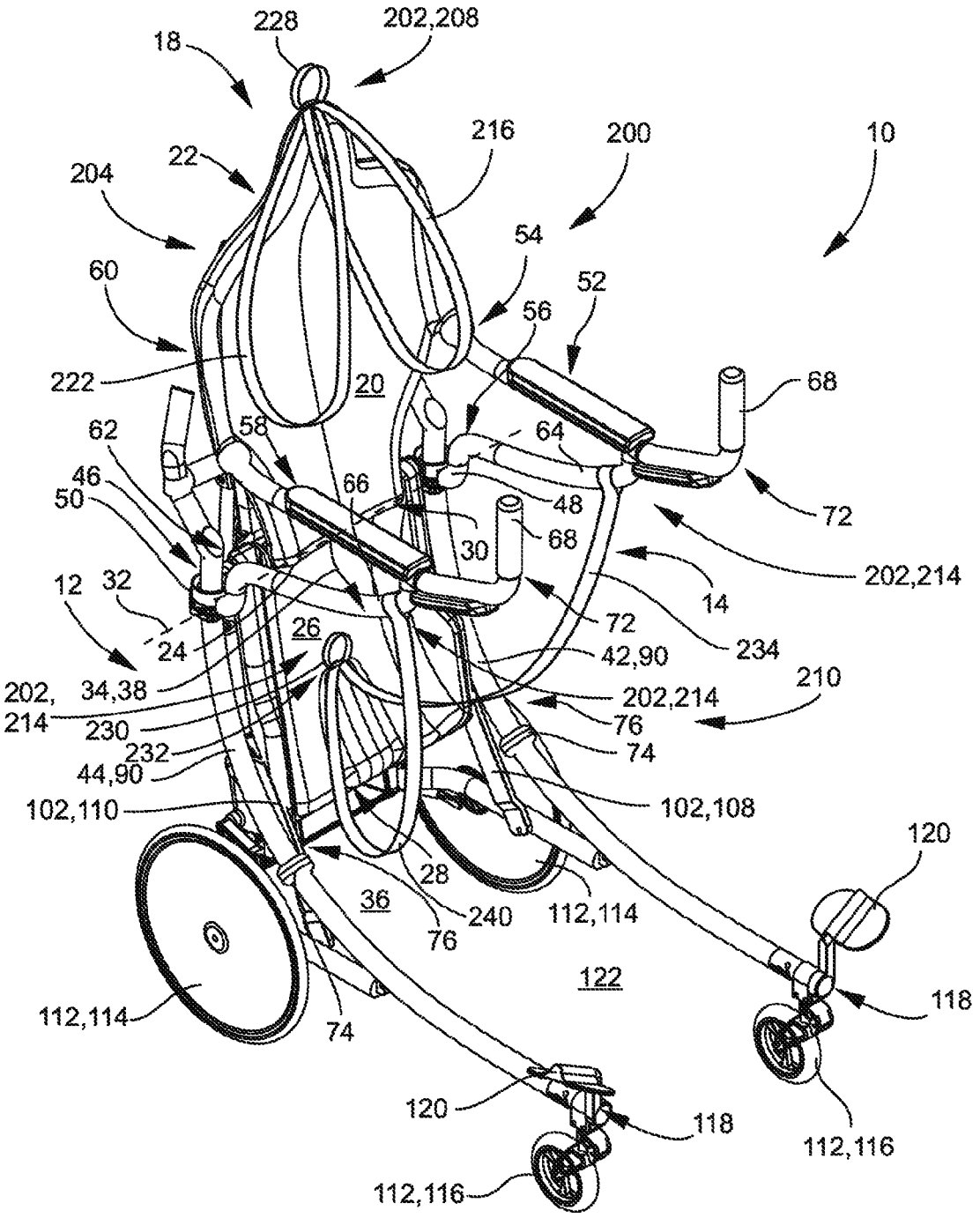
FIG. 13A is a front top perspective view of an exemplary embodiment of the dynamic seating and walking wheelchair according to the instant disclosure in the standing position with a safety harness system in the standing position.
Figure 13B:
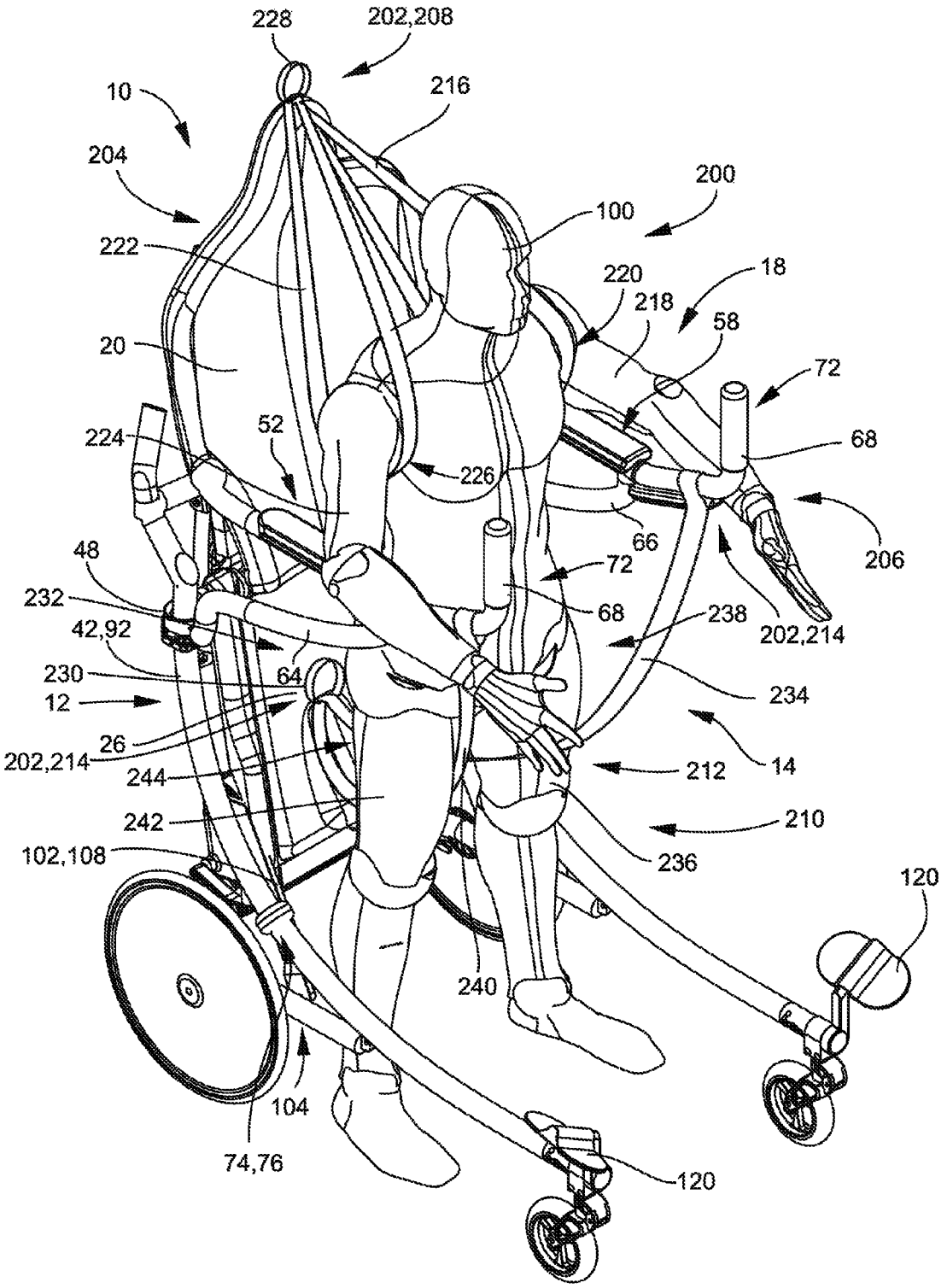
FIG. 13B is another front top perspective view of the dynamic seating and walking wheelchair of FIG. 13A with a human using the safety harness system in the standing position.
Figure 13C:
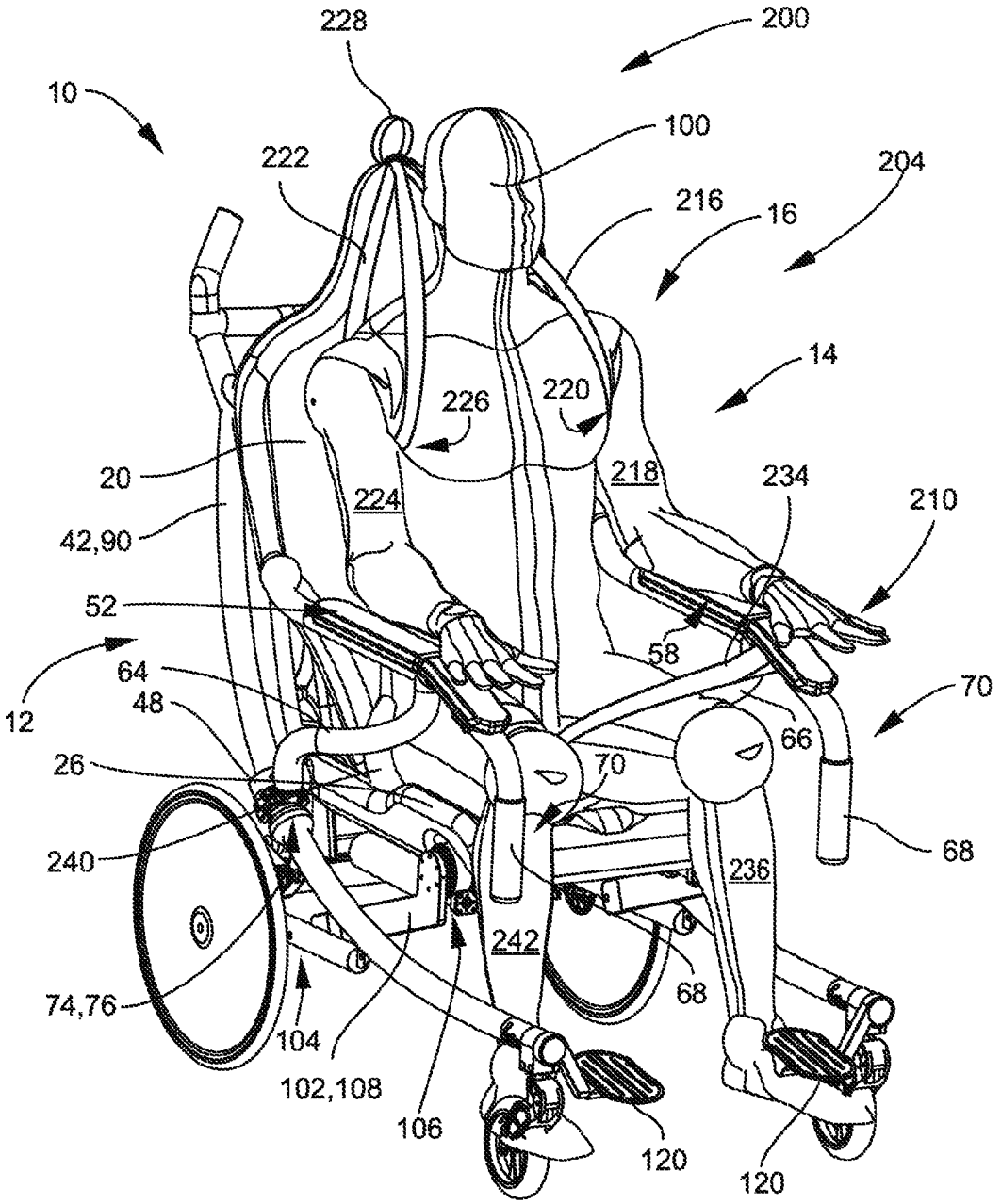
FIG. 13C is another front top perspective view of the dynamic seating and walking wheelchair of FIG. 13A with a human using the safety harness system in the seated position.
Figure 13D:
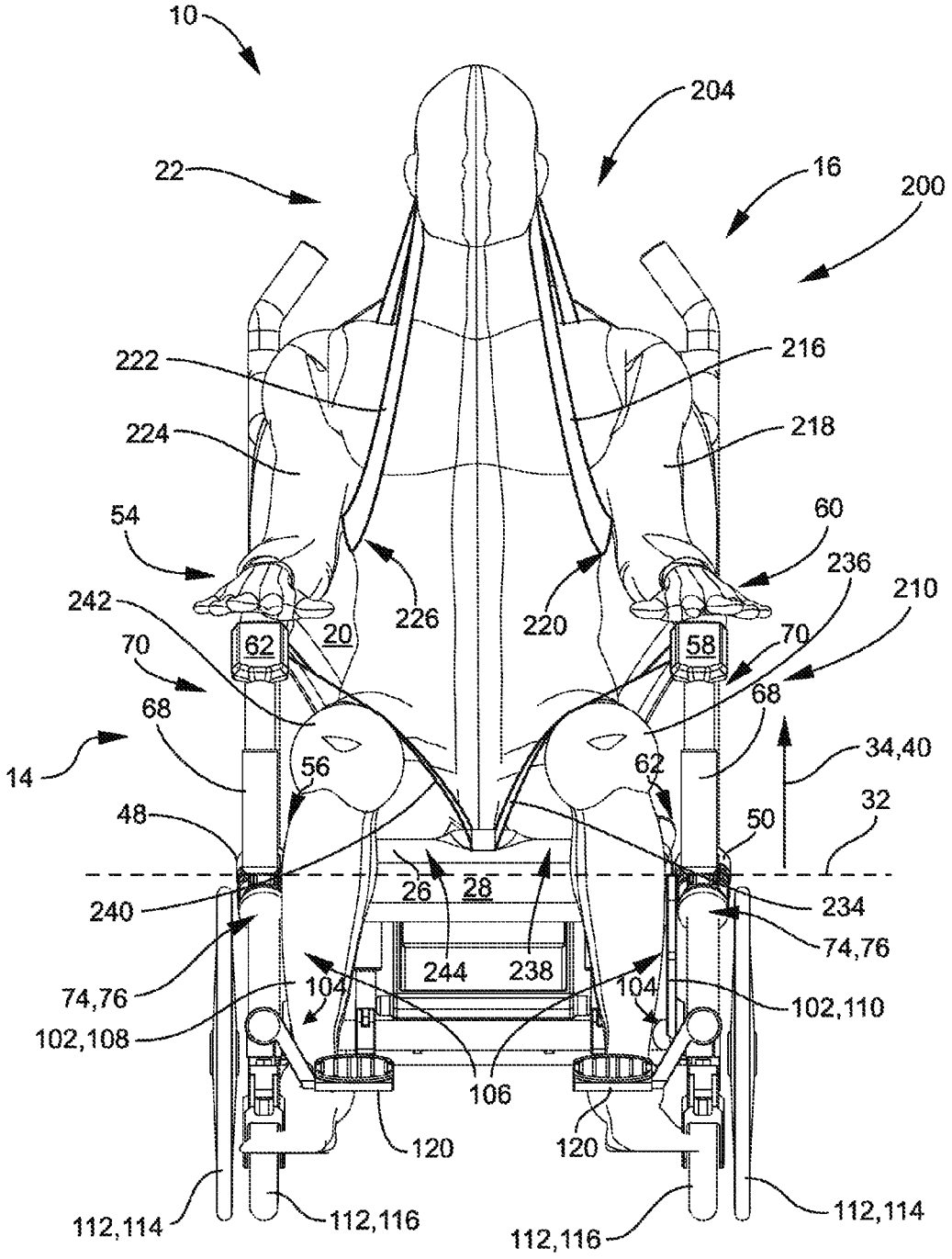
FIG. 13D is a front view of the dynamic seating and walking wheelchair with an active seat with powerlift to stand of FIG. 13A with a human using the safety harness system in the seated position.

Referring now to FIGS. 13A-13C, safety harness system 200 may be included with select embodiments of dynamic seating and walking wheelchair 100. Safety harness system 100 may be connected to connection points 202 on the wheelchair. Connection points 202 may be located or positioned anywhere on apparatus 100, including, but not limited to, anywhere on frame 12 and/or active seat 14. Safety harness system 200 may be configured to provide support to user 100 while standing or walking in standing/walking position 18. See FIG. 13B. However, safety harness system 200 may be configured to allow user 100 to sit in seated position 16 while still wearing safety harness system 200, as shown in FIGS. 13C and 13D. As such, safety harness system 200 may allow user 100 to sit and stand without having to remove the system.

Upper body safety straps 204 may be included in select embodiments of safety harness system 200. Upper body safety straps 204 may be configured to support upper body 206 of user 100 while standing or walking. Upper body straps 204 may be connected to wheelchair apparatus 100 by any means and at any location for supporting upper body 206 of user 100. In select embodiments, upper body safety straps 204 may be connected to wheelchair apparatus 100 by at least one upper connection point 208. As shown in the Figures, in select embodiments, upper body safety straps 204 may include left upper body loop strap loop 216 and right upper body loop strap loop 222. Left upper body strap loop 216 may be configured to go around left arm 218 of user 100 and support left armpit 220 of user 100 while standing or walking. Likewise, right upper body strap loop 222 may be configured to go around right arm 224 of user 100 and support right armpit 226 of user 100 while standing or walking. Upper ring 228 may be included for supporting both left upper body strap loop 216 and right upper body strap loop 222. Upper ring 228 may be positioned at a single upper connection point 208 hanging the left and upper body strap loops 216 and 222 at upper end 22 of seat back 20. In select embodiments, upper straps 204 may be adjustable for adjusting to the heights and sizes of various users 100.

Lower body safety straps 210 may be included in select embodiments of safety harness system 200. Lower body safety straps 210 may be configured to support lower body 212 of user 100 while standing or walking. Lower body safety straps 210 may be connected to wheelchair apparatus 100 by any means and at any location for supporting lower body 212 of user 100. In select embodiments, lower body safety straps 210 may be connected to wheelchair apparatus by at least one lower connection point 214. As shown in the Figures, in select embodiments, lower body safety straps 210 may include lower ring 230, left lower body strap 234, and right lower body strap 240. Lower ring 230 may be for supporting one end of left and right lower body straps 234 and 240. Lower ring 230 may be positioned approximate middle 232 of seat bottom 26. Left lower body strap 234 may be connected between lower ring 230 and left armrest 52. Left lower body strap 234 may be configured to go under left leg 236 of user 100 and support left buttock 238 of user 100 while standing or walking. Similarly, right lower body strap 240 may be connected between lower ring 230 and right armrest 58. Right lower body strap 40 may be configured to go around right leg 242 of user 100 and support right buttock 244 of user 100 while standing or walking. In select embodiments, lower straps 210 may be adjustable for adjusting to the heights and sizes of various users 100.

In use, safety harness system 200 may not only be used for stabilizing or providing support while user 100 is standing or walking, but safety harness system 200 may be utilized in a method of transitioning from sitting to walking. This method may include, but is not limited to, user 100 sitting in apparatus 100 having a plurality of wheels 112 and active seat 14 in seated position 16; connecting safety harness system 200 to apparatus 100 in contact with or around user 100; moving active seat 14 from seated position 16 to standing/walking position 18, wherein seat back 20 and rear end 30 of seat bottom 26 raise thereby providing support for user 100 in coming to standing/walking position 18; user 100 walking while in safety harness system 200 and using armrests 52 an 58 of apparatus 100 for support.

The benefits of dynamic seating and walking wheelchair 10 with active seat 14 with powerlift to stand may be numerous, including, but not limited to the ability to provide support during walking, provide the user with the functionality of a traditional wheelchair and the ability to easily transition between the assisted walking and/or standing versus seated position. Dynamic seating and walking wheelchair 10 may be intended to provide the basic functionality of a traditional wheelchair but also to include active seat 12 with powerlift to stand to assist in the transition of the user from seated position 16 to walking/standing position 18 (and vice versa) and to facilitate the user walking while still obtaining additional support from wheelchair 10.

Another benefit of dynamic seating and walking wheel chair 10 with active seat 12 with powerlift to stand as compared to other devices is the absence of structural members in front of the patient interfering with the normal walking motion. This open access allows a user to easily exit wheelchair 10 for assistance or ease of transitioning for functions such as toilet use. In select embodiments, wheelchair 10 may include a harness or saddle to help support the user weight during its operation and specifically for users unable to support their body weight.

Additional benefits may be realized by health care providers including, but not limited to: the reduction of non-scheduled care giver calls for assisting residents in transitioning (from sitting to standing), for daily activities, reduction in back strain and other injuries among care givers and facility staff from assisting/lifting residents out of wheelchairs for required transitions, the like, etc. Overall business benefits from promoting an environment which supports the health and well-being of residents. Physical rehab facilities may benefit specifically by the convenience and safety of having a single device for both transporting and walking therapy and combinations thereof.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A method of transitioning from sitting to walking, comprising:

a user sitting in an apparatus having a plurality of wheels and an active seat configured to move from a sitting position to a standing position;

initiating the active seat to raise from the sitting position to the standing position, wherein a seat back and a rear end of a seat bottom of the active seat are raised, wherein the full seat bottom moves to a substantially vertical position, thereby providing support for said user in coming to the standing position;

supporting said user while walking.

2. The method of claim 1, wherein the step of supporting the user while walking including supporting the user while walking via the apparatus.

3. The method of claim 1, wherein the step of supporting the user while walking including supporting the user while walking via at least armrests of the apparatus.

4. The method of claim 1, wherein the step of supporting the user while walking including supporting the user while walking via a safety harness system or a saddle.

5. The method of claim 4, wherein the safety harness system including one or more harnesses.

6. The method of claim 4 further comprising the step of connecting a safety harness system to the apparatus in contact with or around said user, wherein said step of supporting the user while walking including supporting the user while walking via the harness system and armrests of the apparatus.

7. The method of claim 6, wherein the step of connecting the harness system includes connecting the harness to two armrests or their supporting members.

8. The method of claim 1, wherein:

initiating the active seat in powered lift automatically engages the braking system for at least one of the wheels; and/or the step of sitting in the apparatus includes rotating at least one armrest for ease of access to the active seat.

9. A method of transitioning from sitting to walking, comprising:

a user sitting in an apparatus having a plurality of wheels and an active seat configured to move from a sitting position to a standing position;

engaging a restraining system with or around said user;

initiating the active seat to raise from the sitting position to the standing position, wherein a seat back and a rear end of a seat bottom of the active seat are raised thereby providing support for said user in coming to the standing position;

supporting said user while walking via the restraining system;

wherein initiating the active seat in powered lift automatically engages the braking system for at least one of the wheels.

10. The method of claim 9, wherein the step of supporting the user while walking including supporting the user while walking via the restraining system and armrests of the apparatus.

11. The method of claim 9, wherein the restraining system including a safety harness system or a saddle.

12. The method of claim 11, wherein the safety harness system including one or more harnesses.

13. The method of claim 11 further comprising the step of connecting a safety harness system to the apparatus in contact with or around said user, wherein said step of supporting the user while walking including supporting the user while walking via the harness system and armrests of the apparatus.

14. The method of claim 13, wherein the step of connecting the harness system includes connecting the harness to two armrests or their supporting members.

15. The method of claim 9, wherein the step of sitting in the apparatus includes rotating at least one armrest for ease of access to the active seat.

16. A method of transitioning from sitting to walking, comprising:

a user sitting in an apparatus having a plurality of wheels and an active seat configured to move from a sitting position to a standing position;

initiating the active seat to raise from the sitting position to the standing position, wherein a seat back and a rear end of a seat bottom of the active seat are raised thereby providing support for said user in coming to the standing position;

supporting said user while walking via at least one harness or saddle;

wherein the step of the user sitting in the apparatus includes rotating at least one armrest for ease of access to the active seat.

17. The method of claim 16, wherein the step of supporting the user while walking including supporting the user while walking via the at least one harness or saddle and the armrests of the apparatus.

18. The method of claim 16 further comprising the step of connecting the at least one harness or saddle to the apparatus in contact with or around said user.

19. The method of claim 18, wherein the step of connecting the at least one harness or saddle includes connecting the at least one harness or saddle to the two armrests or their supporting members.

* * * * *